US008080094B2

(12) United States Patent
Vanderginst

(10) Patent No.: US 8,080,094 B2
(45) Date of Patent: Dec. 20, 2011

(54) ELECTRICALLY STIMULATED AIR FILTER APPARATUS

(75) Inventor: Mark Vanderginst, Scottsdale, AZ (US)

(73) Assignee: Y2 Ultra-Filter, Inc., Cave Creek, AZ (US)

( * ) Notice: Subject to any disclaimer, the term of this patent is extended or adjusted under 35 U.S.C. 154(b) by 1278 days.

(21) Appl. No.: 11/625,619

(22) Filed: Jan. 22, 2007

(65) Prior Publication Data

US 2010/0251895 A1 Oct. 7, 2010

(51) Int. Cl.
*B03C 3/155* (2006.01)

(52) U.S. Cl. ..... 96/66; 96/77; 96/83; 96/88; 96/99

(58) Field of Classification Search ..... 96/66, 69, 96/75, 77, 96, 98–100, 83, 88
See application file for complete search history.

(56) References Cited

U.S. PATENT DOCUMENTS

| | | | | |
|---|---|---|---|---|
| 4,940,470 | A * | 7/1990 | Jaisinghani et al. | 95/78 |
| 5,368,635 | A | 11/1994 | Yamamoto | |
| 5,403,383 | A | 4/1995 | Jaisinghani | |
| 5,540,761 | A | 7/1996 | Yamamoto | |
| 5,647,890 | A | 7/1997 | Yamamoto | |
| 5,855,653 | A | 1/1999 | Yamamoto | |
| 7,122,070 | B1 * | 10/2006 | Krichtafovitch | 95/2 |
| 7,497,893 | B2 * | 3/2009 | Krichtafovitch | 95/2 |
| 7,785,404 | B2 * | 8/2010 | Leng et al. | 96/21 |
| 7,815,720 | B2 * | 10/2010 | McKinney | 96/63 |
| 2008/0156186 | A1 * | 7/2008 | McKinney | 95/2 |

* cited by examiner

*Primary Examiner* — Richard L Chiesa
(74) *Attorney, Agent, or Firm* — Parsons & Goltry; Michael W. Goltry; Robert A. Parsons

(57) ABSTRACT

An electrically stimulated air filter apparatus for removing particles from an air stream includes a housing maintaining an ionizer electrode and electrically induced electrodes for producing electrical fields that interact with particles in an air stream passing through the housing to create clusters of the particles, and an electrically induced filter for collecting and separating the clusters of the particles from the air stream passing through the housing.

23 Claims, 14 Drawing Sheets

ELECTRICALLY STIMULATED AIR FILTER APPARATUS

FIELD OF THE INVENTION

The present invention relates to apparatus and methods for filtering contaminants from air streams.

BACKGROUND OF THE INVENTION

Airborne particles can be removed from a polluted air stream by a variety of physical processes. Common types of equipment for collecting fine particulates include, for example, cyclones, scrubbers, electrostatic precipitators, and baghouse filters.

Most air-pollution control projects are unique. Accordingly, the type of particle collection device, or combination of devices, to be employed normally must be carefully chosen in each implementation on a case-by-case basis. Important particulate characteristics that influence the selection of collection devices include corrosivity, reactivity, shape, density, and size and size distribution, including the range of different particle sizes in the air stream. Other design factors include air stream characteristics (e.g., pressure, temperature, and viscosity), flow rate, removal efficiency requirements, and allowable resistance to airflow. In general, cyclone collectors are often used to control industrial dust emissions and as precleaners for other collection devices. Wet scrubbers are usually applied in the control of flammable or explosive dusts or mists from such sources as industrial and chemical processing facilities and hazardous-waste incinerators; they can handle hot air streams and sticky particles. Large scale electrostatic precipitators or filtration devices and fabric-filter baghouses are often used at power plants.

Electrostatic precipitation or filtration, which are interchangeable terms, is a commonly used method for removing fine particulates from air streams. In an electrostatic precipitator, an electric charge is imparted to particles suspended in an air stream, which are then removed by the influence of an electric field. A typical precipitation unit or device includes baffles for distributing airflow, discharge and collection electrodes, a dust clean-out system, and collection hoppers. A high DC voltage, often as much as 100,000 volts in large scale applications, is applied to the discharge electrodes to charge the particles, which then are attracted to oppositely charged collection electrodes, on which they become trapped.

In a typical large-scale electrostatic precipitator the collection electrodes consists of a group of large rectangular metal plates suspended vertically and parallel to each other inside a boxlike structure. There are often hundreds of plates having a combined surface area of tens of thousands of square meters. Rows of discharge electrode wires hang between the collection plates. The wires are given a negative electric charge, whereas the places are grounded and thus become positively charged.

Particles that stick to the collection plates are removed periodical iv when the plates are shaken, or "rapped." Rapping is a mechanical technique for separating the trapped particles from the plates, which typically become covered with a 6-mm (0.2-inch) layer of dust. Rappers are either of the impulse (single-blow) or vibrating type. The dislodged particles are collected in a hopper at the bottom of the unit and removed for disposal. An electrostatic precipitator can remove exceptionally small particulates on the order of 1 micrometer (0.0004 inch) with an efficiency exceeding 99 percent. The effectiveness of electrostatic precipitators in removing fly ash from the combustion gases of fossil-fuel furnaces accounts for their high frequency of use at power stations.

Large-scale electrostatic precipitators are expensive, difficult to build, and quite large. However, electrostatic filtration is exceedingly efficient and highly reliable. As a result, skilled artisans have devoted considerable effort and resources toward the development of small-scale electrostatic precipitators or air filtration devices specifically adapted for small scale applications, such as for filtering breathing. Although considerable attention has been directed toward the development of small-scale and portable electrostatic filtration devices utilized principally to filter breathing air, existing implementations are difficult to construct, expensive, must be constructed to strict and often unattainable tolerances, and cannot be tuned or calibrated as needed to meet specific and/or changing environmental conditions or air filtering requirements. Given these and other deficiencies in the art of electrostatic air filters, the need for continued improvement is evident.

SUMMARY OF THE INVENTION

It is an object of the invention to provide an electrically stimulated air filter apparatus for removing particles from an air stream including a housing maintaining an ionizer electrode and electrically induced electrodes for producing electrical fields that interact with particles in an air stream passing through the housing to create clusters of the particles and an electrically induced filter maintained in the housing for collecting and separating the clusters of the particles from the air stream passing through the housing which low in cost, which is safe, which efficiently removes airborne particles from an air stream, and which is capable of neutralizing or killing microbial and other disease, germ and like biological particles.

According to the invention, an electrically stimulated air filter apparatus includes an air inlet leading to an air flow pathway through the chamber, and an air outlet leading from the air flow pathway through the chamber. A filter is disposed in the air flow pathway between the air inlet and the air outlet for entrapping contaminants in an air stream passing through the air flow pathway from the air inlet to the air outlet. An ionizer electrode, electrically connected for carrying a first potential, is disposed in the air flow pathway between the air inlet and the filter, an upstream electrode is disposed in the air flow pathway between the air inlet and the ionizer electrode, and a downstream electrode is disposed in the air flow pathway between the air outlet and the filter. An abutment is disposed in the air flow pathway between the air outlet and the downstream electrode, which acts on the downstream electrode urging the downstream electrode in contact against the filter. The first potential carried by the ionizer electrode imparts through induction a) a second potential to the upstream electrode forming a first ionizing field between the upstream electrode and the ionizer electrode, and b) a third potential to the downstream electrode forming a second ionizing field between the downstream electrode and the ionizer electrode. The abutment acting on the downstream electrode urges the downstream electrode in contact against the filter maintaining the second ionizing field with the filter. In one embodiment, the upstream electrode is electrically isolated inhibiting arcing from occurring at the upstream electrode. In another embodiment, the ionizer electrode is grounded. In a further embodiment, a resister is coupled to the upstream potential and is adjusted to obtain a predetermined value of the first potential. The downstream electrode is preferably grounded, and the filter is preferably a dielectric filter. The ionizer electrode consists of a planar array of ionizing wires parallel to the upstream electrode and the downstream electrode.

According to the invention, an electrically stimulated air filter apparatus includes a housing defining a chamber, an air inlet leading to an air flow pathway through the chamber, and an air outlet leading from the air flow pathway through the chamber. A filter is disposed in the air flow pathway between the air inlet and the air outlet for entrapping contaminants in an air stream passing through the air flow pathway from the air inlet to the air outlet. An ionizer electrode is disposed in the air flow pathway between the air inlet and the filter. The ionizer electrode is electrically connected for carrying a first potential, and is carried by a frame. An upstream electrode is disposed in the air flow pathway between the air inlet and the ionizer electrode, and a downstream electrode, engaged to the filter, is disposed in the air flow pathway between the air outlet and the filter. The first potential carried by the ionizer electrode imparts through induction a) a second potential to the upstream electrode forming a first ionizing field between the upstream electrode and the ionizer electrode, and b) a third potential to the downstream electrode forming a second ionizing field between the downstream electrode and the ionizer electrode. The engagement of the downstream abutment with the filter maintains the second ionizing field with the filter. The frame is engagable to the housing at a first position of the ionizer electrode toward the upstream electrode and away from the downstream electrode for increasing the second potential of the upstream electrode and decreasing the third potential of the downstream electrode, and a second position of the ionizer electrode away from the upstream electrode and toward the downstream electrode for decreasing the second potential of the upstream electrode and increasing the third potential of the downstream electrode. An engagement assembly is provided for releasably securing the frame in the first and second positions of the ionizer electrode, which includes an element thereof carried by the frame, and first and second complemental elements thereof carried by the housing. The first complemental element releasably engaged to the element corresponds to the first position of the ionizer electrode, and the second complemental element releasably engaged to the element corresponds to the second position of the ionizer electrode. An abutment is disposed in the air flow pathway between the air outlet and the downstream electrode. The abutment acts on the downstream electrode urging the downstream electrode in engagement with the filter. In one embodiment, the upstream electrode is electrically isolated inhibiting arcing from occurring at the upstream electrode. In another embodiment, the downstream electrode is grounded. In yet a further embodiment, a resister is coupled to the upstream potential, and is adjusted to obtain a predetermined value of the first potential. Preferably, the downstream electrode is grounded, and the filter is a dielectric filter. The ionizer electrode consists of a planar array of ionizing wires parallel to the upstream electrode and the downstream electrode.

According to the invention, an electrically stimulated air filter apparatus includes a housing defining a chamber, an air inlet leading to an air flow pathway through the chamber, and an air outlet leading from the air flow pathway through the chamber. A filter is disposed in the air flow pathway between the air inlet and the air outlet for entrapping contaminants in an air stream passing through the air flow pathway from the air inlet to the air outlet. An ionizer electrode, electrically connected for carrying a first potential, is disposed in the air flow pathway between the air inlet and the filter. An upstream electrode is disposed in the air flow pathway between the air inlet and the ionizer electrode, and a downstream electrode is disposed in the air flow pathway between the air outlet and the filter. An abutment is disposed in the air flow pathway between the air outlet and the downstream electrode, which acts on the downstream electrode urging the downstream electrode in contact against the filter. The first potential carried by the ionizer electrode imparts through induction a) a second potential to the upstream electrode forming a first ionizing field between the upstream electrode and the ionizer electrode, and b) a third potential to the downstream electrode forming a second ionizing field between the downstream electrode and the ionizer electrode. The abutment acting on the downstream electrode urges the downstream electrode in contact against the filter maintaining the second ionizing field with the filter. The ionizer electrode, the filter, and the abutment are together secured to a chassis, which is, in turn, mounted to the housing for movement between a first position of the ionizer electrode, the filter and the abutment toward the upstream electrode for increasing the second potential of the upstream electrode, and a second position of the ionizer electrode, the filter, and the abutment away from the upstream electrode for decreasing the second potential of the upstream electrode. In one embodiment, the upstream electrode is electrically isolated inhibiting arcing from occurring at the upstream electrode. In another embodiment, the downstream electrode is grounded. In yet a further embodiment, a resister is coupled to the upstream potential and is adjusted to obtain a predetermined value of the first potential. Preferably, the downstream electrode is grounded, and the filter is a dielectric filter. The ionizer electrode consists of a planar array of ionizing wires parallel to the upstream electrode and the downstream electrode. A lock is provided between the housing and the chassis, and is movable between an unlocked position permitting movement of the chassis relative to the housing, and a locked position for securing the chassis in a fixed position relative to the housing.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION OF PREFERRED EMBODIMENTS

Figure 1:
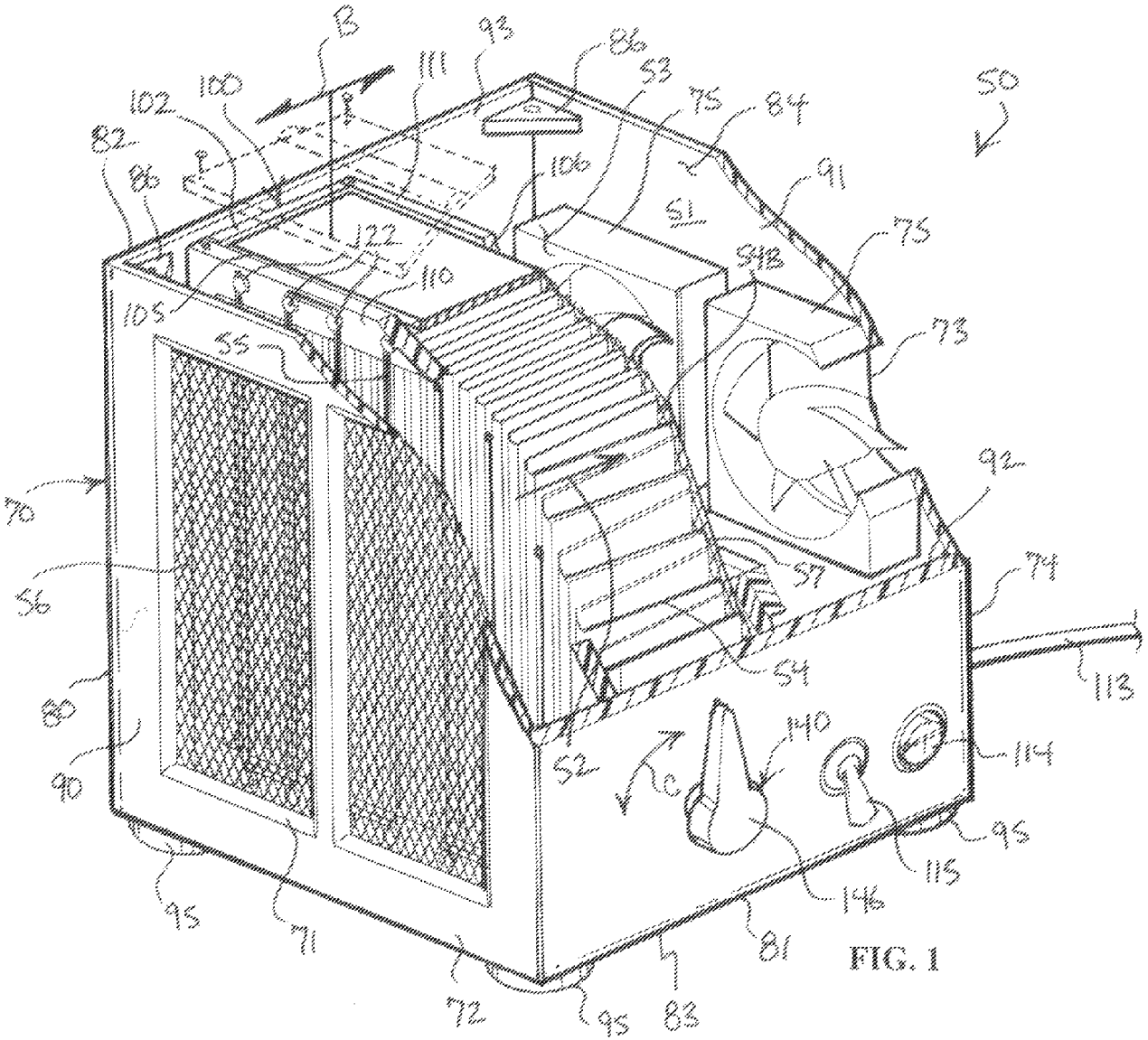
FIG. 1 is a perspective view of an electrically stimulated air filter apparatus, with portions thereof removed and broken away illustrating a housing defining an air flow pathway therethrough, a filter, an ionizer electrode, and opposed upstream and downstream electrodes in an air flow pathway formed through the housing, and a chassis mounted to the housing supporting the filter, the ionizer electrode, and the downstream electrode in the air flow pathway.

Turning now to the drawings, in which like reference characters indicate corresponding elements throughout the several views, attention is first directed to FIG. 1 in which there is seen a perspective view of an electrically stimulated air filter apparatus 50 constructed and arranged in accordance with the principle of the invention. With continuing reference to FIG. 1 and additional regard to FIG. 8, apparatus 50 includes an air flow pathway 51, an air stream 52 passing along air flow pathway 51 through a chamber 53, and a filter 54 disposed in air flow pathway 51 for entrapping contaminants in air stream 52 passing through air flow pathway 51. An ionizer electrode 55 is electrically connected for carrying a potential, and is disposed in air flow pathway 51 upstream of filter 54. An induced electrode 56 is disposed in air flow pathway 51 upstream of ionizer electrode 55, and an induced electrode 57 is disposed in air flow pathway 51 downstream of filter 54, and engages filter 54. Electrode 56 is separated from ionizer electrode 55 by a gap or distance D1, and electrode 57 is separated from ionizer electrode by a gap or distance D2. Ionizer electrode 55, electrode 56, and electrode 57 are upright, spaced-apart, and parallel relative to one another. Because electrode 56 is disposed in air flow pathway 51 upstream of ionizer electrode 55, electrode 56 is referred to as the upstream electrode in the ensuing discussion. Also, because electrode 57 is disposed in air flow pathway 51 downstream of ionizer electrode, electrode 57 is referred to as the downstream electrode in the ensuing discussion.

Figure 8:
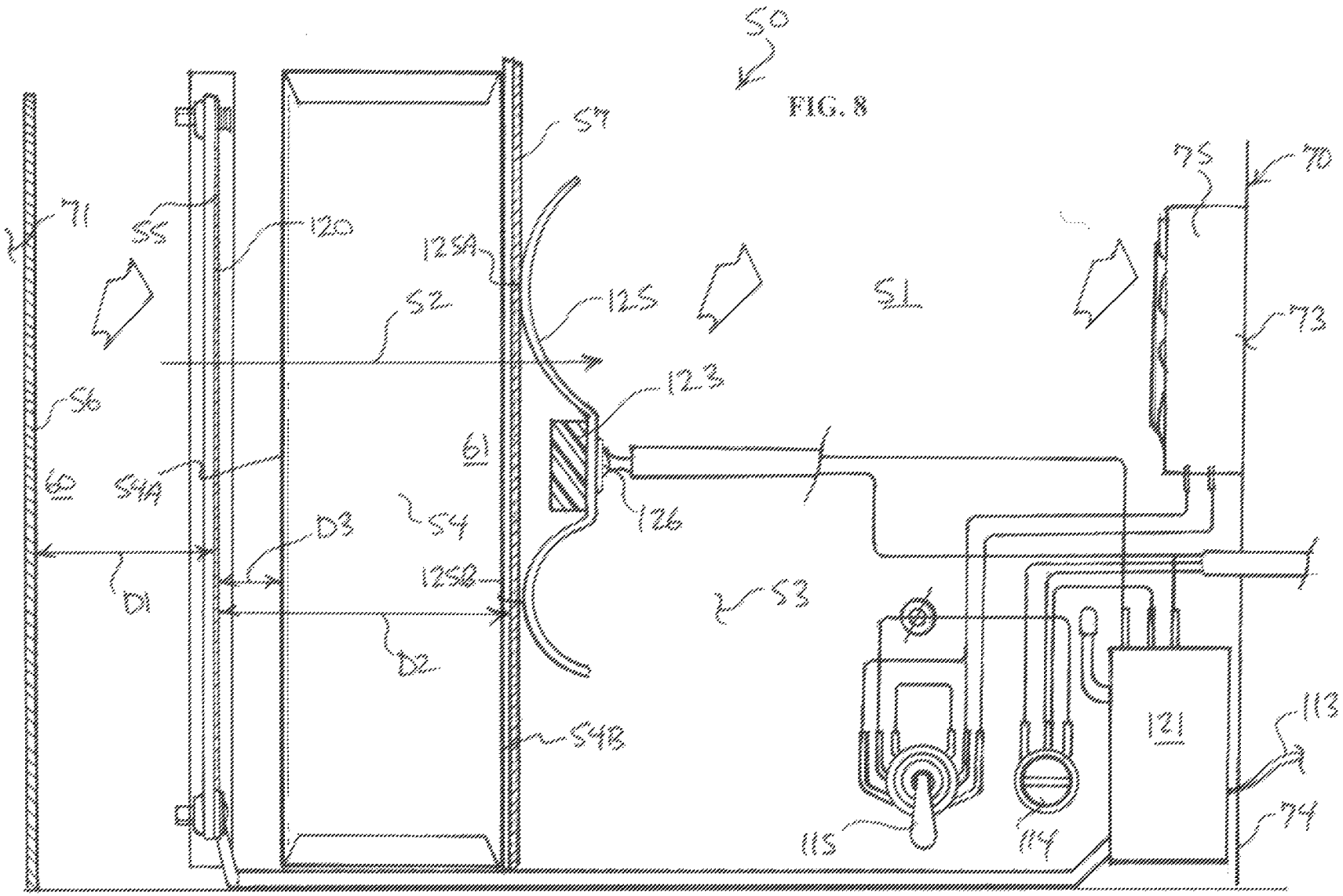
FIG. 8 is a schematic representation of the electrically stimulated air filter apparatus of FIG. 1 illustrating the filter disposed in the air flow pathway, the ionizer electrode disposed upstream of the filter in the air flow pathway, the upstream electrode disposed upstream of the ionizer electrode in the air flow pathway, the downstream electrode disposed downstream of the filter in the air flow pathway, and an abutment downstream of the downstream electrode in the air flow pathway acting on the downstream electrode urging the downstream electrode in contact against the filter.
Figure 9:
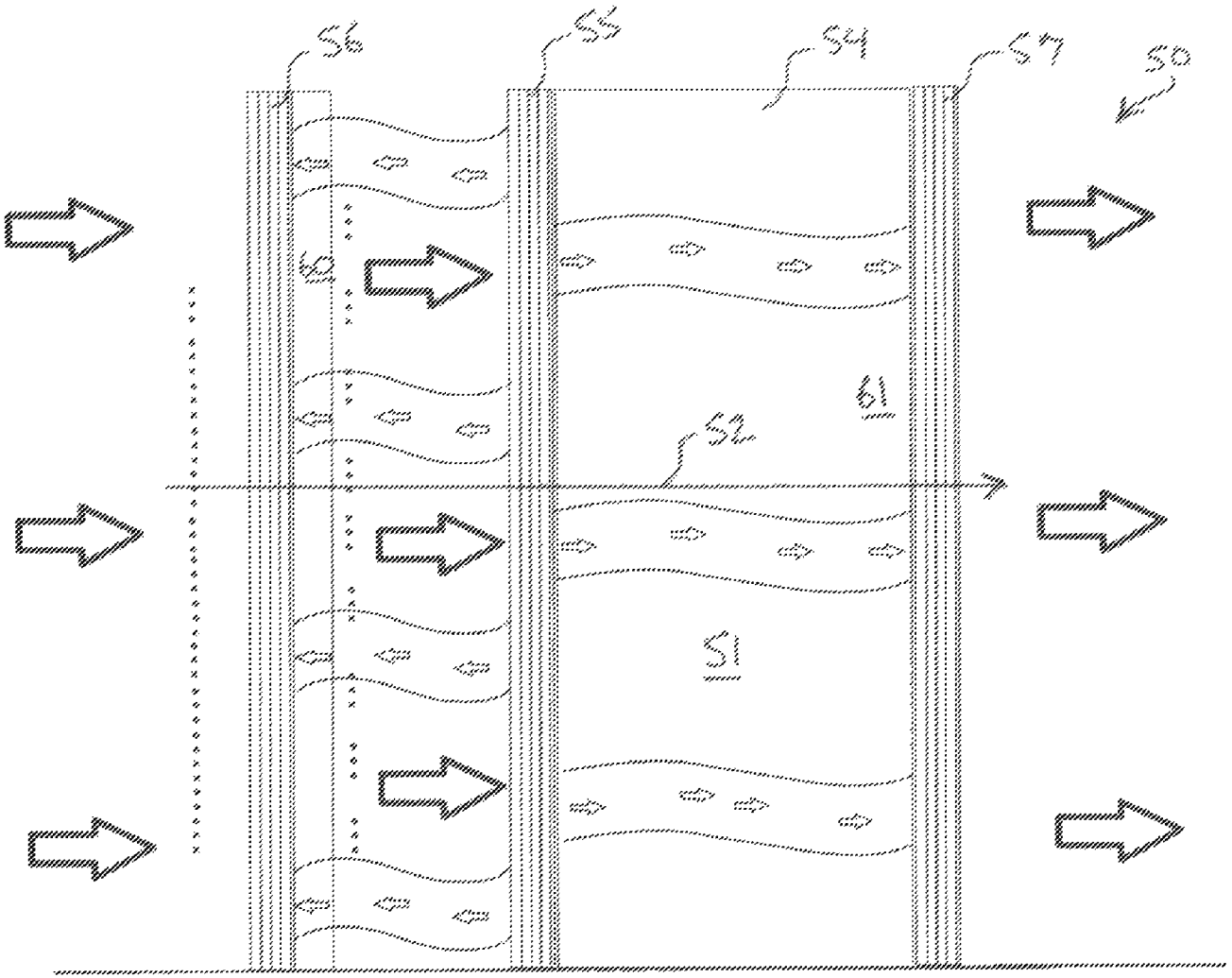
FIG. 9 is a highly generalized schematic representation of the filter, the ionizer electrode, the upstream electrode, and the downstream electrode of the electrically stimulated air filter apparatus of FIG. 1, and an air stream passing with respect thereto.

Referencing FIGS. 8 and 9, the potential carried by ionizer electrode 55 imparts through induction a potential to upstream electrode 56 forming ionizing field 60 between upstream electrode 56 and ionizer electrode 55 in juxtaposition along upstream electrode 56, and a potential to downstream electrode 57 forming ionizing field 61 between downstream electrode 57 and ionizer electrode 55 in juxtaposition along downstream electrode 57. The engagement of downstream electrode 57 against filter 54 imparts ionizing field 61 to filter 54 and maintains ionizing field 61 with filter 54, according to the principle of the invention.

The potential across ionizer electrode 55 is positive, and the potentials across upstream and downstream electrodes 56 and 57 are each also positive but lesser in magnitude in comparison to the potential across ionizer electrode 55. Because the positive potentials across upstream and downstream electrodes 56 and 57 are each lesser in magnitude than the positive potential applied across ionizer electrode 55, the upstream and downstream electrodes 56 and 57 each have a net negative charge as compared to the potential across ionizer electrode 55.

Through induction, positively charged electrons flow or otherwise migrate from ionizer electrode 55 across distance D1 to upstream electrode 56 and to downstream electrode 57, thereby forming an induced potential in upstream electrode 56 and an induced potential in downstream electrode 57, according to the principle of the invention. As the positively charged electrons generated by ionizer electrode 55 reach upstream electrode 56 and induce a potential in upstream electrode 56, ionizing field 60 is formed along upstream electrode 56 between upstream electrode 56 and ionizer electrode 55. Ionizing field 60 is positive, but is lesser in magnitude in comparison to the potential across ionizer electrode 55 and therefore has a net negative charge as compared to the potential across ionizer electrode 55. As the positively charged electrons generated by ionizer electrode 55 reach downstream electrode 57 and induce a potential in downstream electrode 57, ionizing field 61 is formed along downstream electrode 57 between downstream electrode 57 and ionizer electrode 55. Ionizing field 61 is positive, but is lesser in magnitude in comparison to the potential across ionizer electrode 55 and therefore has a net negative charge as compared to the potential across ionizer electrode 55. According to the principle of the invention, the engagement of downstream electrode 57 against filter 54 imparts and maintains ionizing field 61 in filter 54, thereby imparting or otherwise inducing a positive charge to filter 54, which is lesser in magnitude than the positive charge across ionizer electrode 55.

Air stream 52 passes along air flow pathway 51 through chamber 53 in a direction from upstream electrode 56 to downstream electrode 57. As air stream 52 passes through chamber 53, air stream 52 passes first through upstream electrode 56 and then through ionizing field 60. As particles conveyed by air stream 52, such as dust particles, mold particles, microbial particles, smoke particles, and other airborne particles, encounter ionizing field 60, ionizing field 60 imparts or otherwise induces a potential or electric charge to the particles suspended in air stream 52 causes the particles to become attracted to each other forming clusters of the particles, which are then conveyed by air stream 52 downstream through ionizer electrode 55 to filter 54, which entraps the clusters of particles thereby removing the clusters of particles from air stream 53. The clusters of particles formed by the interaction of the particles with ionizing field 60 are positively charged. The positive charge to the clusters is imparted to the clusters by ionizing field 60, and is lesser in magnitude than the positive charge of ionizing field 61 applied across filter 54. Accordingly, as the clusters of particles reach filter 54, the net negative charge applied to the clusters as compared to the net positive charge applied across filter 54 by ionizing field 61 causes the clusters to be electrically attracted to filter 54 thereby producing an aggressive and comprehensive removal of the clusters of particles from air stream 52 by filter 54 and a highly efficient and effective filtration efficiency, according to the principle of the invention.

When particles pass through ionizing field 60, not only do the particles become attracted to one another to form clusters, a churning motion caused by the Van Der Walls Effect is imparted to the particles, which helps the particles impact one another and group together to form clusters of particles. The potential imparted to filter 54 by ionizing field 61 attracts and adheres the clusters of particles to filter 54, according to the principle of the invention.

Referring to FIG. 1, apparatus 50 is preferably self-contained and portable and easily transported from place to place, and incorporates a housing 70, which constitutes the supporting structure for the various elements of apparatus 50, and which bounds and defines chamber 53 which in turn bounds and defines air flow pathway 51 therethrough, and that also defines an inlet 71 at an upstream end 72 of housing 70 leading to air flow pathway 52, and an outlet 73 at an opposing downstream end 74 of housing 70 leading from air flow pathway 52. Air flow pathway 51 passes through housing 70 from inlet 71 to outlet 73. Air passing inwardly through inlet 71 into air flow pathway 51 is intake air and air passing outwardly through outlet 73 from air flow pathway 51 is filtered outtake air.

Air stream 52 is artificially-produced and passes through air flow pathway 51 bound by housing 70 from inlet 71 to outlet 73. In this embodiment, air stream 52 is produced by blowers or fans 75 mounted to housing 70 at outlet 73, which when activated forcibly draw air into air flow pathway 51 through housing 70 from inlet 71 to outlet 73. In the present embodiment, fans 75 draw air into air flow pathway 51 through inlet 71. If desired, fans 75 can be mounted to housing at inlet 71, which when activated will forcibly push air into airflow pathway 51 through inlet 71. Fans 75 can be located at any suitable location that when activated will function to produce air stream 52 through air flow pathway 51 formed through housing 70. If desired, fans can be located not only adjacent to outlet 73, but also adjacent to inlet 71.

In the present embodiment, two fans 75 are utilized each in conjunction with an opening formed in downstream end 74 of housing 70. The openings associated with fans 75 together characterize outlet 73. Although two fans 75 are utilized in the preferred embodiment, less or more may be employed. Furthermore, although two openings formed in downstream end 74 of housing 70 characterize outlet 73 in the immediate embodiment, outlet 73 may be formed with less or more openings, if desired. Fans 75 are conventional, electric-powered fans. Any suitable form of fan or blower may be used in conjunction with apparatus 50.

Figures 2, 3, 4, 5:
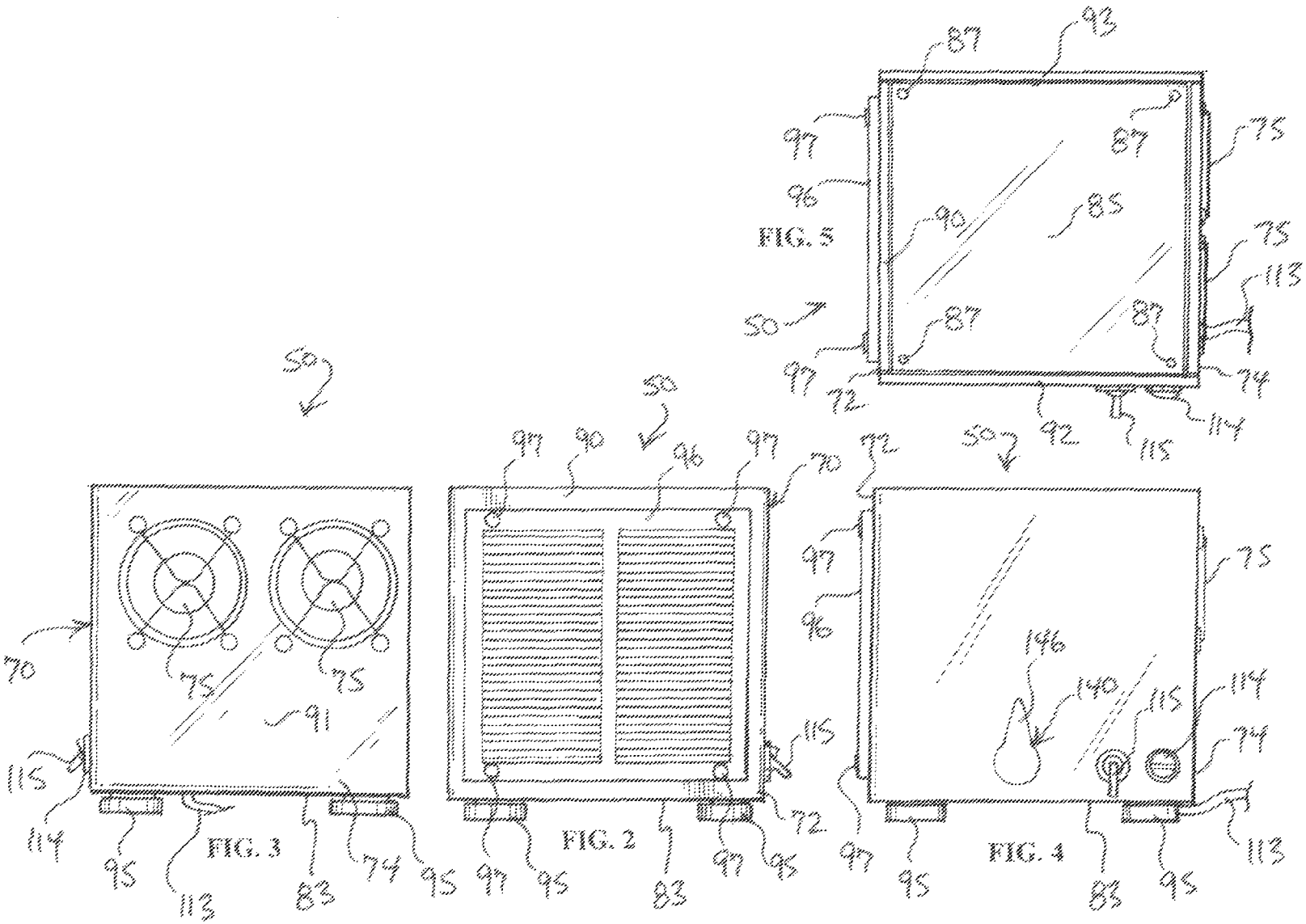
FIG. 2 is a front elevational view of the electrically stimulated air filter apparatus of FIG. 1.
FIG. 3 is a rear elevational view of the electrically stimulated air filter apparatus of FIG. 1.
FIG. 4 is a left side elevational view of the electrically stimulated air filter apparatus of FIG. 1.
FIG. 5 is a top plan view of the electrically stimulated air filter apparatus of FIG. 1.
Figure 6:
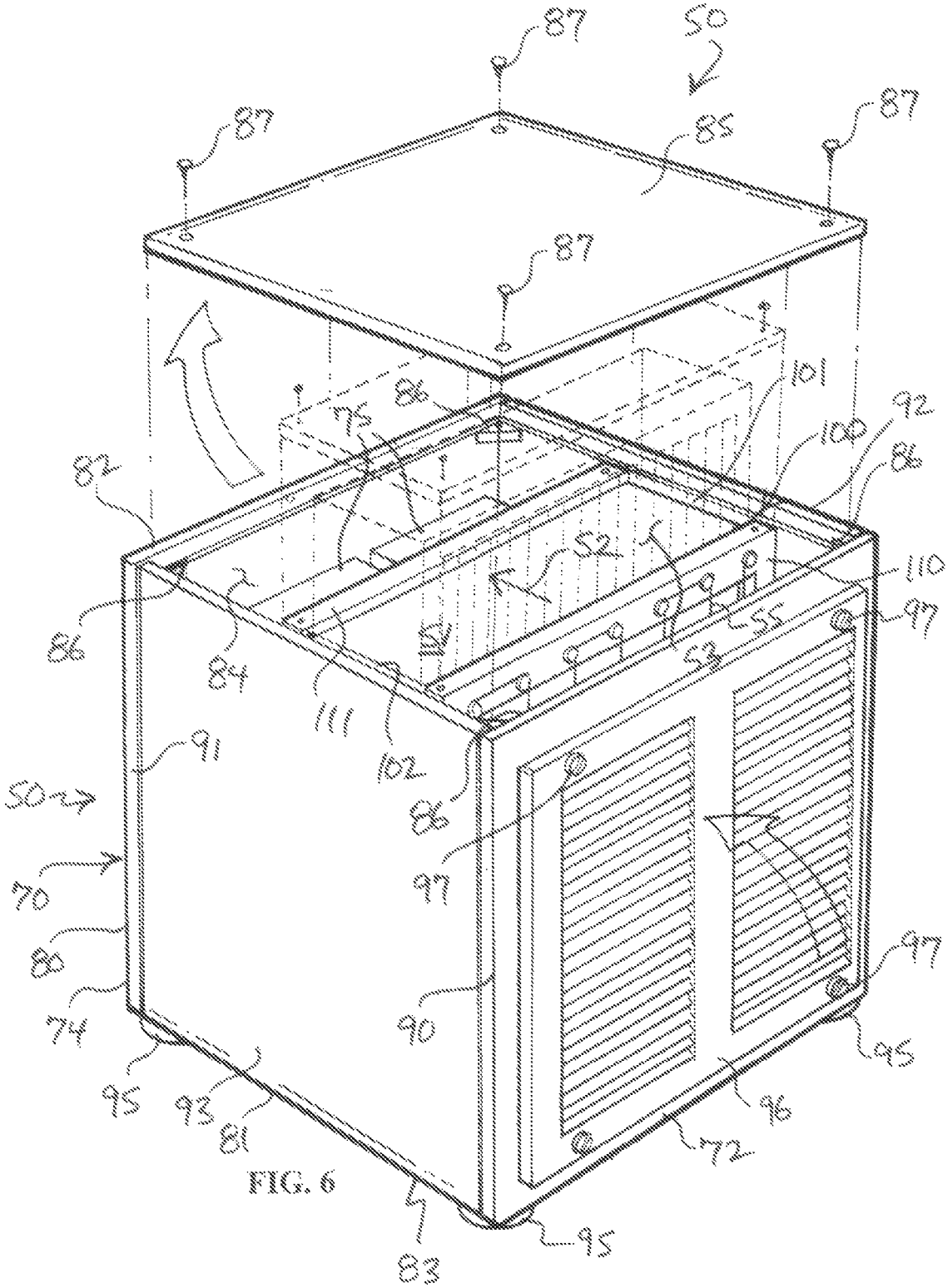
FIG. 6 is a partially schematic perspective view of the electrically stimulated air filter apparatus of FIG. 1 with a lid thereof shown as it would appear removed for illustrative purposes.

Looking to FIGS. 1 and 6, housing 50 consists of an upstanding continuous sidewall 80 defining a continuous lower edge 81 and an opposed continuous upper edge 82. A generally horizontal bottom wall 83 (FIGS. 12-14) is rigidly affixed to continuous lower edge 82 forming a generally horizontal supporting floor of housing 70. The inner surfaces of continuous sidewall 80 and bottom wall 83 together bound and define chamber 53, and continuous upper edge 82 bounds and defines an opening 84 leading into chamber 53, which is closed with a closure or lid 85 illustrated in FIGS. 5 and 6 to enclose chamber 53.

Upstanding continuous sidewall 80 consists of opposing, spaced-apart, and generally parallel upstanding front and rear walls 90 and 91, and opposed, spaced-apart, and generally parallel upstanding side walls 92 and 93. Front wall 90 is formed with inlet 71, and rear wall 91 is formed with outlet 73 as shown in FIG. 1. Fans 75 illustrated in FIG. 1 are secured to rear wall 91, such as with screws, rivets, adhesive, etc. Lid 85 is broad and flat, is positionable at opening 84 to close opening 84, and is supported by housing 70 at opening 84 by blocks 86 mounted to housing 70 in chamber 53 adjacent to continuous upper edge 82 at the corners formed between front and rear walls 90 and 91, and sidewalls 92 and 93. Threaded fasteners 87 are used to secure lid 85 to blocks 86 in the present embodiment, and those having regard for the art will readily appreciate that lid 85 may be secured to blocks 76 with other forms of fasteners. Lid 85 is easily attached and removed relative to housing 70, for allowing easy access to chamber 53 for accessing the various components therein for maintenance and replacement, and for replacing filter 54 when needed with a new filter. Feet 95 are secured to bottom wall 83, and are utilized to support apparatus 50 relative to a supporting surface, such as the floor, a table-top, a countertop, or the like. Four feet 95 are employed in the present embodiment, although more or less may be used. As a matter of disclosure, FIG. 2 is a front elevational view of apparatus 50, FIG. 3 is a rear elevational view of apparatus 50, FIG. 4 is a left side elevational view of apparatus 50, and FIG. 5 FIG. 5 is a top plan view of apparatus 50. In FIGS. 2-6, a protective vent 96 is shown attached to front wall 90 exteriorly of housing 70 with threaded fasteners 97. Vent 96 is depicted as a matter of example, and may be omitted, if desired. Housing 70, and any and all fasteners used to secure the various components of apparatus 50 to housing 70 are formed of non-conductive material, such as polyethylene, polypropylene, or other selected plastic or plastic-like material suitable to prevent alteration of the potentials across ionizer electrode 55, and upstream and downstream electrodes 56 and 57.

Referencing FIG. 1, upstream electrode 56 is disposed adjacent to inlet 71 in air flow pathway 51 between inlet 71 and ionizer electrode 55, and downstream electrode 57 in air flow pathway 51 is positioned between outlet 73 and filter 54 as clearly shown in FIG. 8. Ionizer electrode 55 located in air flow pathway 51 is positioned between upstream electrode 56 and filter 54. Accordingly, ionizer electrode 55 is located downstream of upstream electrode 56 and upstream of filter 54 and downstream electrode 57, upstream electrode 56 is located upstream of ionizer electrode 55, and downstream electrode 57 is located downstream of filter 54 and ionizer electrode 55.

Upstream and downstream electrodes 56 and 57 are constructed of a porous conductive material, typically a flattened and expanded aluminum grid, screen or mesh. Looking to FIG. 1, upstream electrode is applied interiorly of housing 70 against the inner face of front panel 90 facing chamber 53 confronting inlet 71, and is affixed at its perimeter edge to the inner face of front panel 90 with a non-conductive adhesive, although non-conductive threaded fasteners or rivets or the like may be used, if desired. Because housing 70 is formed of non-conductive material, upstream electrode 56 is electrically isolated in a preferred embodiment being under no influence or control by any device attached thereto, such as a ground or resistor or other device capable of influencing the induced potential thereacross provided by ionizer electrode 55. Because upstream electrode 56 is electrically isolated in a preferred embodiment, upstream electrode 56 is a "floating" electrode being free of the influence of a ground or resistor or other device, the potential imparted to upstream electrode 56 through induction by ionizer electrode 55 lower in magnitude than the potential across ionizer electrode 55 as previously discussed, and the incidence of arcing occurring between ionizer electrode 55 and upstream electrode 56 is restrained. If desired, upstream electrode 56 may be grounded. However, grounding upstream electrode 56 tends to increase the incidence of arcing between ionizer electrode 55 and upstream electrode 56, whereby distance D1 between ionizer electrode 55 and upstream electrode 56 must be carefully chosen to prevent the incident of arcing therebetween. Unlike upstream electrode 56, downstream electrode 57 is grounded.

Referring to FIG. 1, a chassis 100 is disposed in chamber 53 and is mounted to housing 70. Chassis 100 carries filter 54, ionizer electrode 55, and downstream electrode 57, according to the principle of the invention. Chassis 100 maintains filter 54, ionizer electrode 55, and downstream electrode 57 in air flow pathway 51. Chassis 100, like housing 70, is formed of non-conductive material, such polyethylene, polypropylene, or other selected plastic or plastic-like material.

Figure 7:
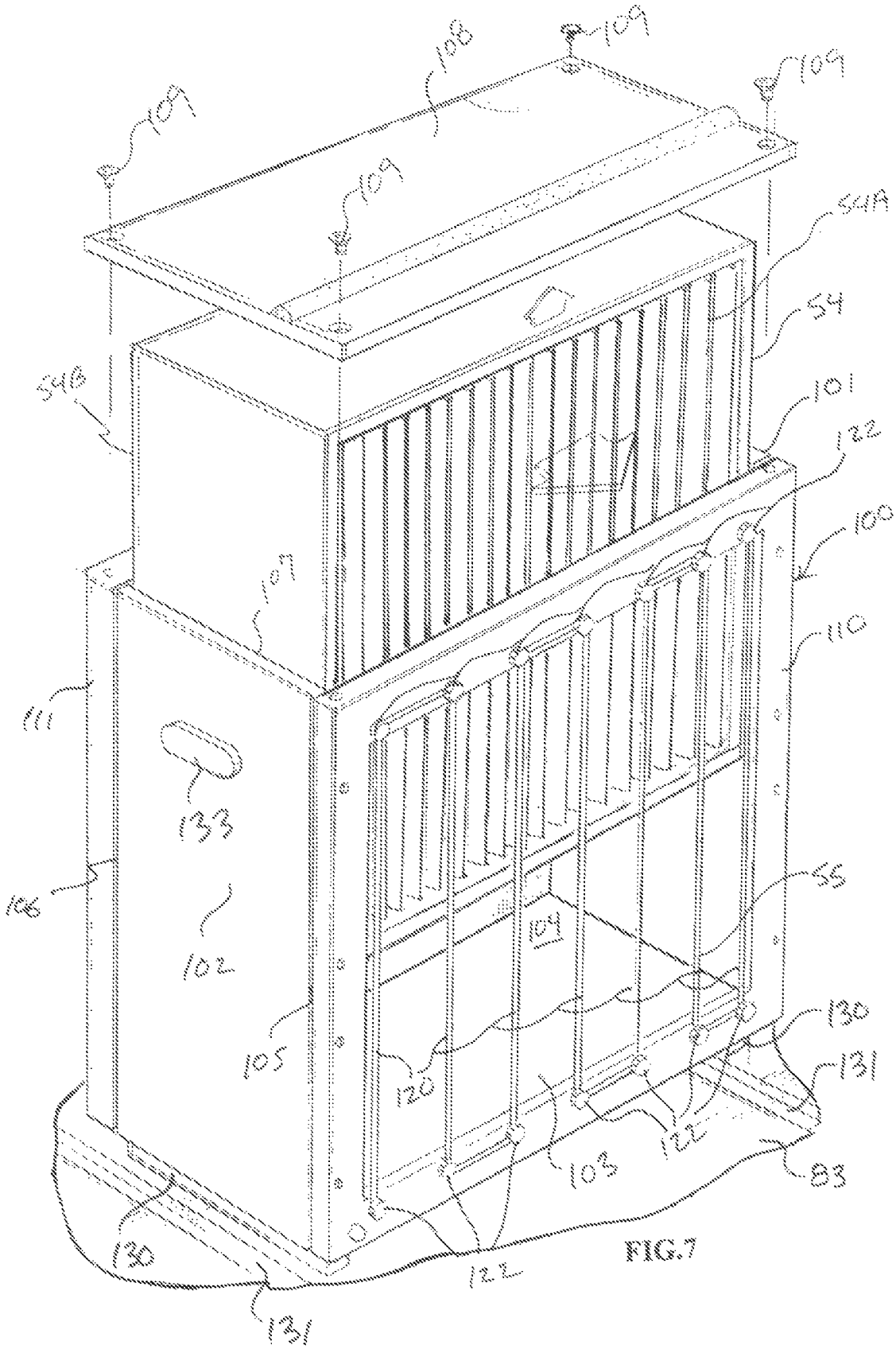
FIG. 7 is a perspective view of the chassis of the electrically stimulated air filter apparatus of FIG. 1 that supports the ionizer electrode and defines a receiving area for the filter, which is shown as it would appear partially received in the receiving area.

Referencing FIG. 7, chassis 100, which may be considered part of housing 70 or otherwise an extension of housing 70, consists of opposed upstanding parallel sidewalls 101 and 102 extending upright relative to a generally horizontal bottom wall 103, which together bound a receiving area 104 for filter 54, an open upstream end 105, an opposing open downstream end 106, and an open upper end 107. As best seen in FIG. 1, open upstream end 105 faces inlet 71, and open downstream end 106 faces outlet 73. Chassis 100 incorporates parametric frames 110 and 111 affixed to open upstream and downstream ends 105 and 106, respectively, such as with a suitable adhesive, welding, non-conductive fasteners, or the like. Ionizer electrode 55 is carried by frame 110, and downstream electrode 57 is carried by frame 111. When properly situated in chamber 53 of housing 70 as shown in FIG. 1, chassis 100 is located between inlet 71 and outlet 73, bottom wall 103 of chassis 100 is set against the inner surface of bottom wall 83 of housing 70, as indicated in FIG. 7, and extends across chamber 53 from sidewall 92 to sidewall 93, sidewall 101 is juxtaposed relative to the inner surface of sidewall 92 and extends upwardly from bottom wall 83 of housing 70 to proximate upper edge 82, and sidewall 102 is juxtaposed relative to the inner surface of sidewall 93 and extends upwardly from bottom wall 83 of housing 70 to proximate upper edge 82 as generally illustrated in FIG. 1.

Referencing to FIG. 7, ionizer electrode 55 consists of high voltage ionizing wires 120 formed of conductive material. Wires 120 are arranged in a planar, upright array. The planar array formed by wires 120 carried by frame 110 extends across open upstream end 105 of chassis 100 in air flow pathway 51, and is parallel to upstream and downstream electrodes 56 and 57 as generally illustrated in FIG. 8. Wires 120 are actually formed by a single tungsten wire, which is attached to frame 110, and strung across open upstream end 105, with non-conductive pins 122 affixed to frame 110.

Ionizer electrode 55 is energized by a high voltage direct current power supply 121 illustrated in FIG. 8, which in the present embodiment is mounted interiorly of housing 70 within chamber 53 downstream of downstream electrode 57 adjacent to downstream end 74 of housing 70. Power supply 121 may be mounted to housing 70 at any selected location. Conventional electrical wiring is employed to electrically connect ionizer electrode 55 to power supply 121, which when energized imparts a potential, namely, a positive potential, to ionizer electrode 55, namely, wires 120.

Power supply 121 is wired in a conventional manner to a power cord 113, which incorporates a conventional plug (not shown) for plugging into a conventional alternating current outlet for providing power to apparatus 50. A power switch 114 and a fan control switch 115 are each wired to power supply 121 utilizing conventional wiring. Switches 114 and 115 are each mounted to sidewall 92 of housing 70 as seen in FIGS. 1 and 4, and are disposed externally of housing 70 thereby being readily accessible. Power switch 114 is a conventional toggle switch or other conventional switch, which is used to open and close a circuit between power cord and power supply 121 for turning power supply 1210N and OFF. Upon turning power switch 114 ON, ionizer electrode 55 is energized. Ionizer electrode is de-energized in the OFF position of switch 114. Fan control switch 115 is also a conventional toggle switch or other conventional switch. When switch 114 is ON thereby energizing power supply 121, fan control switch 115 is used to open and close a circuit between power supply 121 and fans 75 for turning fans 750N and OFF. In the ON position of switches 114 and 115, ionizer electrode 55 is energized and fans 75 are activated forming air stream 52 through air flow pathway 51.

Power supply 121 is an AC to DC non-regulated high voltage power supply, which provides high voltage to ionizer electrode 55 forming the potential thereacross. For apparatus 50 to operate according to desired specifications as disclosed herein, preferably power supply 121 provides a voltage of approximately 14-30 KVDC, with a preferred operating voltage being approximately 15.5 KVDC. Based on the operating voltage range provided by power supply 121, distance D1 between ionizer electrode 55 and upstream electrode 55 is preferably 1-3 inches, with a preferred distance D1 being approximately 1.8 inches based on the preferred operating voltage of approximately 15.5 KVDC. Distance D2 between ionizer electrode 55 and downstream electrode 57 is not overly critical to the function of apparatus 50 according to the structure of apparatus 50 herein disclosed. According to the preferred embodiment disclosed herein, distance D2 is preferably is approximately 5-10 inches.

As previously explained, the magnitude of ionizing fields 60 and 61 is determined principally by the voltage provided by power supply 121 across ionizer electrode 55, in addition to the magnitude of distances D1 and D2. At a fixed or predetermined voltage of power supply 121, the magnitude of ionizing field 60 increases as distance D1 between ionizer electrode 55 and downstream electrode 56 decreases and decreases as distance D1 increases, and the magnitude of ionizing field 61 increases as distance D2 between ionizer electrode 55 and downstream electrode 57 decreases and decreases as distance D2 increases. Again, distance D2 between ionizer electrode 55 and downstream electrode 57 is not as critical to the proper operation of apparatus 50 as is distance D1 between ionizer electrode 55 and upstream electrode 56. Accordingly, at a fixed or predetermined voltage of power supply 121, the operating or filtering characteristics of apparatus 50 may be selectively varied principally through the adjustment of distance D1 between ionizer electrode 55 and upstream electrode 56. The selected intensity of ionizing fields 60 and 61, and more importantly ionizing field 60, is largely dependent on specific needs and applications. Nevertheless, apparatus 50 incorporates structure that allows for the adjustment or tuning of ionizing fields 60 and 61, and principally the adjustment of ionizing field 60, which will be discussed later in this specification. Furthermore, downstream electrode 57 is preferably grounded as previously indicated. Downstream electrode 57 may be grounded directly to an earth ground and/or to the negative side of power supply 121, or indirectly by coupling abutment 125 engaging downstream electrode 57 to a ground as illustrated schematically in FIG. 8, which shows abutment 125 coupled to an earth ground and to the negative side of power supply 121.

Figure 12:
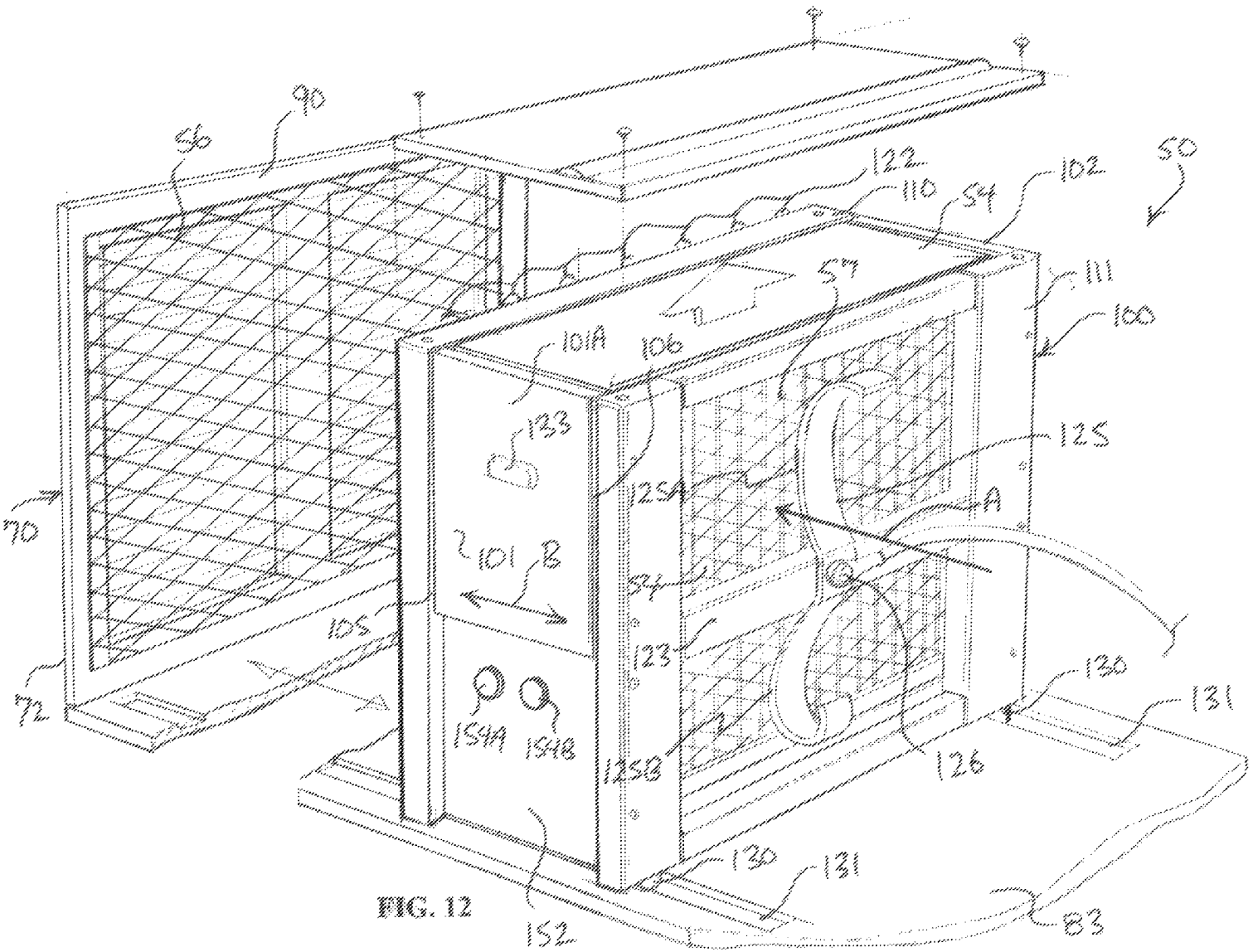
FIG. 12 is a fragmented, partially schematic perspective view of the electrically stimulated air filter apparatus of FIG. 1 illustrating the chassis mounted to the housing.

Referencing FIG. 12, the perimeter of downstream electrode 57 is affixed to frame 111. Downstream electrode 57 extends across open downstream end 106 in air flow pathway 51, and is positioned against open downstream end 106 between frame 111 and open downstream end 106. Frame 111 is fashioned with a support member 123, which is located downstream of downstream electrode 57 and extends thereacross the back or downstream side of downstream electrode 57 in air flow pathway 51. An abutment 125 is affixed to support member 123, and is secured thereto at a generally intermediate position thereof with a fastener 126, such as a screw, rivet, or the like. Abutment 125, which in this instance is a length of spring steel, acts on downstream electrode 57 and urges downstream electrode 57 inwardly into receiving area 104 (referenced in FIG. 104) as generally indicated by the arrowed line A in FIG. 12. In the immediate embodiment, the length of spring steel forming abutment 125 is secured to support member 123 at a midpoint thereof, and extends outwardly from either side of the midpoint thereof to opposing ends 125A and 125B, respectively, which are applied against downstream electrode 57 and act against downstream electrode 57 urging downstream electrode 57 into receiving area 104.

Referring again to FIGS. 1 and 7, filter 54 consists of a broad pleated body, which provides an increased surface area allowing for capture of a greater quantity of contaminants, including clusters of particles. Filter 54 is formed of dielectric material 116, such as glass or other plastic fiber material having a low dielectric and low conductivity. According to the preferred embodiment set forth herein, filter 54 is preferably fashioned of fiberglass with approximately 6-10% binder material incorporated to bond the fiberglass together in the formation of filter 54. Filter 54 neither contains nor incorporates conductive material. Filter 54 is positioned in receiving area 104 through open upper end 107 of chassis 100. Filter 54 and receiving area 104 are each commonly shaped, being that of a generally rectangular form. The size of receiving area 104 is only somewhat greater than the overall size of filter 54 ensuring a relatively tight fit, yet not so tight making it easy to install and remove filter 54 relative to receiving area 104. For reference purposes as seen in FIG. 1, filter 54 has an upstream face 54A facing upstream toward ionizer electrode 55, and a downstream face 54B facing downstream toward downstream electrode 57. After filter 54 is set into receiving area 104, a lid 108 is secured to chassis 100 with non-conductive fasteners, such as non-conductive screws 109, to enclose receiving area 104. Lid 108 is easily attached and removed relative to chassis 100, for allowing filter 54 to be replaced as needed. In the present embodiment, filter 54 is approximately 11.5 inches in width, approximately 11.5 inches in height, approximately 4 inches deep, and is formed of dielectric material that is approximately 0.22 inches thick.

When filter 54 is set into receiving area 104, downstream electrode 57 is made to contact downstream face 54B of filter 54 with the provision of abutment 125, according to the principle of the invention. In particular, abutment 125 acting on downstream electrode 57 urges downstream electrode into receiving area 104 in the direction indicated by arrowed line A in FIG. 12 and into engagement against downstream face 54B of filter 54, which advantageously maintains ionizing field 61 (FIG. 8) with filter 54 eliminating the need to incorporate conductive or relatively conductive material with filter 54 as is used in the prior art. Because abutment 125 acts on downstream electrode 57 for maintaining contact or engagement between downstream electrode 57 and filter 54, incorporating relatively conductive or conductive material with filter 54 is altogether unnecessary. Furthermore, because a significant, if not substantially the entire, portion of downstream face 54B of filter 54 confronting downstream electrode 57 is maintained in contact with downstream electrode 57 according to the preferred embodiment set forth herein, the electrical field strength or potential across filter 54 defined by ionizing field 61 formed through inductance from ionizer electrode 55 is provided and maintained. In FIG. 8, there is a perceptible gap between downstream face 54B of filter 54 and downstream electrode 57, which is shown merely for illustrative purposes, with the understanding that the engagement between downstream electrode 57 and downstream face 54B of filter with the provision of abutment 125 according to the principle of the invention would leave no perceptible gap therebetween.

By utilizing abutment 125 to urge substantially all of the extent of downstream electrode 57 confronting downstream face 54B of filter 54 into engagement against downstream face 54B of filter 54, the potential imparted to downstream electrode 57 through inductance from ionizer electrode 55 is brought closer to the dielectric material forming filter 54 and more evenly distributed throughout the peaks and valleys of the pleats of filter 54. This configuration results in increased current flow or ionization downstream of ionizer electrode 55 thereby providing adequate charging or polarization of the dielectric filter material forming filter 54 and consequently a high filtering efficiency.

Chassis 100, including the components it carries, namely, filter 54, ionizer electrode 55, downstream electrode 57, and abutment 125, is situated in chamber 53, and is mounted to housing 70 so as to maintain filter 54, ionizer electrode 55, and downstream electrode 57 in air flow pathway 51 as previously discussed, such that a gap or distance D3 is defined between upstream face 54A of filter 54 and ionizer electrode 55 formed by ionizing wires 120, gap or distance D1 is defined between ionizer electrode 55 and upstream electrode 56, and gap or distance D2 is defined between ionizer electrode 55 and downstream electrode 57, as referenced in FIG. 8. The absolute sizes of distances D1, D2 relative to the voltage applied to ionizer electrode 55 and upstream and downstream electrodes 56 and 57 characterizes the operation of apparatus 50 as previously discussed.

Figure 13:
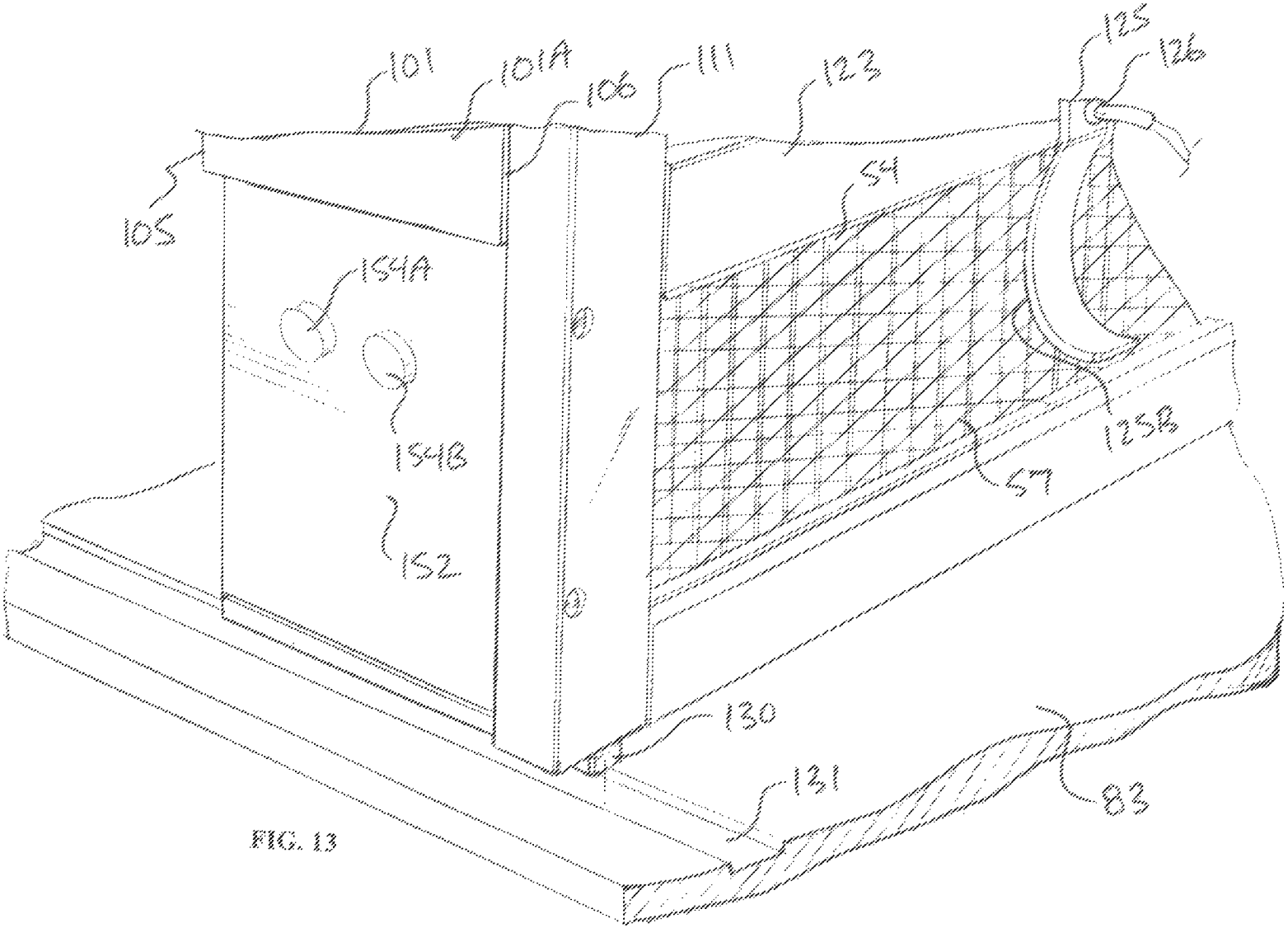
FIG. 13 is an enlarged, fragmented perspective view of the electrically stimulated air filter apparatus of FIG. 1 illustrating the chassis mounted to the housing.

Referring in relevant part to FIGS. 12 and 13, chassis 100 is mounted to housing 70 for movement in reciprocal directions as indicated by the double arrowed line B in FIGS. 1 and 12 with respect to upstream electrode 56. In this specific embodiment, bottom wall 103 of chassis 100 is mounted to bottom wall 83 of housing 70 with a tongue-and-groove assembly, which, as best seen in FIG. 12, includes opposed parallel tongues 130 affixed to the outer surface of bottom wall 83 of chassis 100 that are accepted into corresponding opposed parallel grooves 131 formed in the inner surface of bottom wall 83 of housing 70. Grooves 131 extend along bottom wall 83 from proximate upstream end 72 of housing 70 to proximate downstream end 74 of housing 70. The receipt of tongues 130 in grooves 131 in the placement of chassis 100 onto bottom wall 83 of housing permit a guided movement of chassis 100 and the components chassis 100 carries in reciprocal directions as indicated by the double arrowed line B in FIGS. 1 and 12 relative to upstream electrode 56, according to the principle of the invention. Tongues 130 are carried by chassis 100 and grooves 131 are carried by housing 70 in the present embodiment, and this arrangement can be reversed, if desired.

Figure 14:
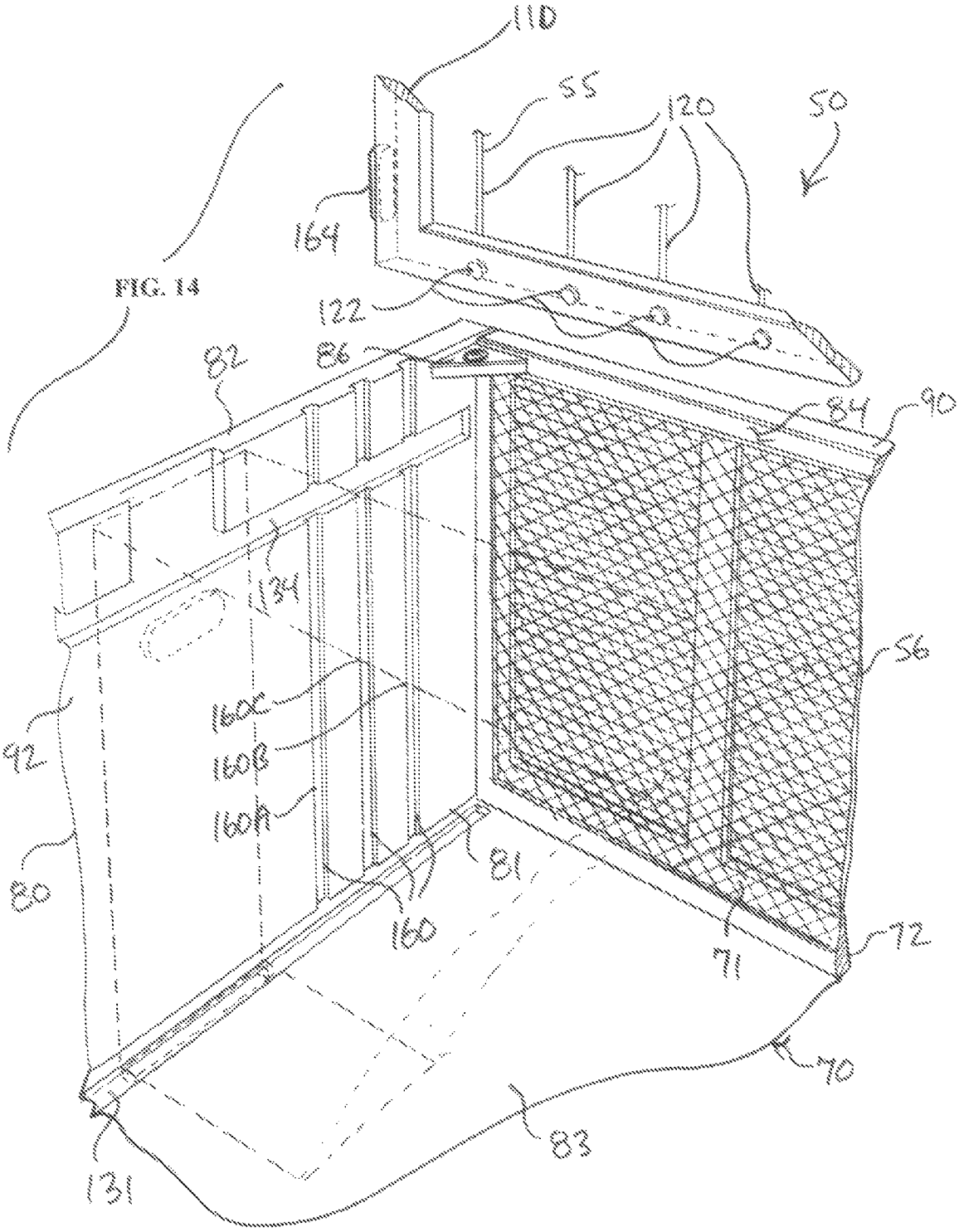
FIG. 14 is a fragmented perspective view of the interior of the housing of FIG. 1 including a fragmented perspective view of the ionizer electrode shown as it would appear detached with respect to the housing.
Figure 15:
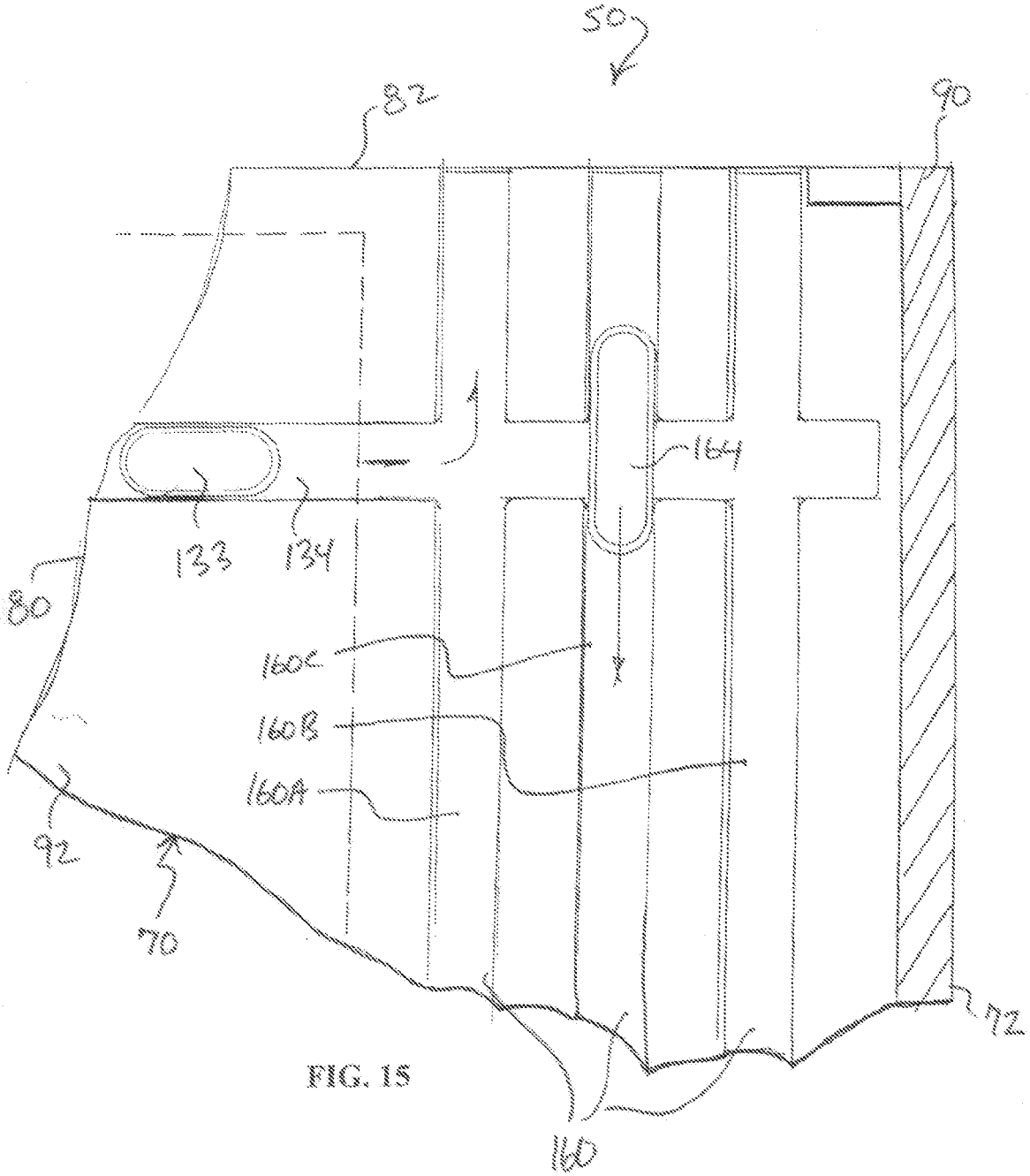
FIG. 15 is a fragmented, side elevational view of an interior wall of the housing of FIG. 14 illustrating grooves formed therein, including a generally horizontal groove and a plurality of upright grooves.

Tongues 130 and grooves 131 may be associated with chassis 100 and housing 70 at any selected location therebetween. Although two corresponding pairs of tongue and groove engagement pairs are utilized in the preferred embodiment, less or more may be used, if desired. As a matter of illustration and reference in this regard, in FIG. 12 there is illustrated a tongue 133 formed on the outer surface of sidewall 101 of chassis 100, which is positioned to be received within a corresponding groove or way 134 in FIG. 14 formed in the inner surface of sidewall 92 of housing 70 adjacent to upper edge 82 extending between upstream and downstream ends 72 and 74 of housing 70. FIG. 15 illustrates the relationship of tongue 133 shown as it would appear received by groove or way 134. A similar tongue and groove or way may be provided between sidewall 102 of chassis 100 and sidewall 93 of housing 70, if desired.

Figure 17:
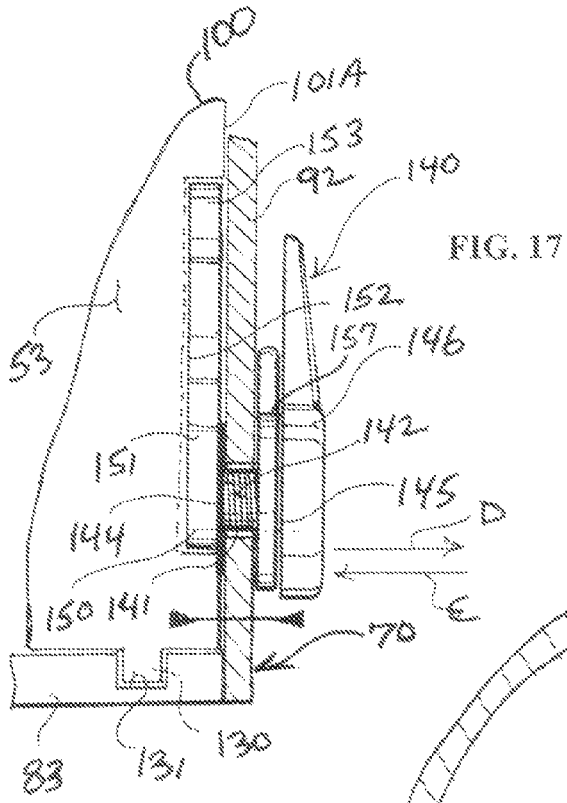
FIG. 17 is a vertical sectional view of the adjustment assembly of FIG. 16.

An adjustment assembly 140 is provided to adjust chassis 100, and the components it carries including filter 54 and ionizer electrode 55 and downstream electrode 57 and abutment 125, in reciprocal directions as indicated by the double arrowed line B in FIGS. 1 and 12, and between locked and unlocked positions relative to housing 70. Looking to FIG. 17, adjustment assembly 140 consists of a threaded shaft 141 that extends through an opening 142 formed in sidewall 92 of housing 70. Shaft 141 has an inner end 144 directed into chamber 53 of housing 70 toward the outer surface of sidewall 101 of chassis 100, and an opposing outer end 145 directed outwardly relative to sidewall 92 of housing 70 to which is secured a dial 146, which is juxtaposed along side the outer surface of sidewall 92. Inner end 144 is affixed to a lower end 150 of an elongate arm 151, which resides in a recess 152 formed in outer surface 101A of sidewall 101, and which extends upwardly from lower end 150 to an opposed upper end 153.

Figure 16:
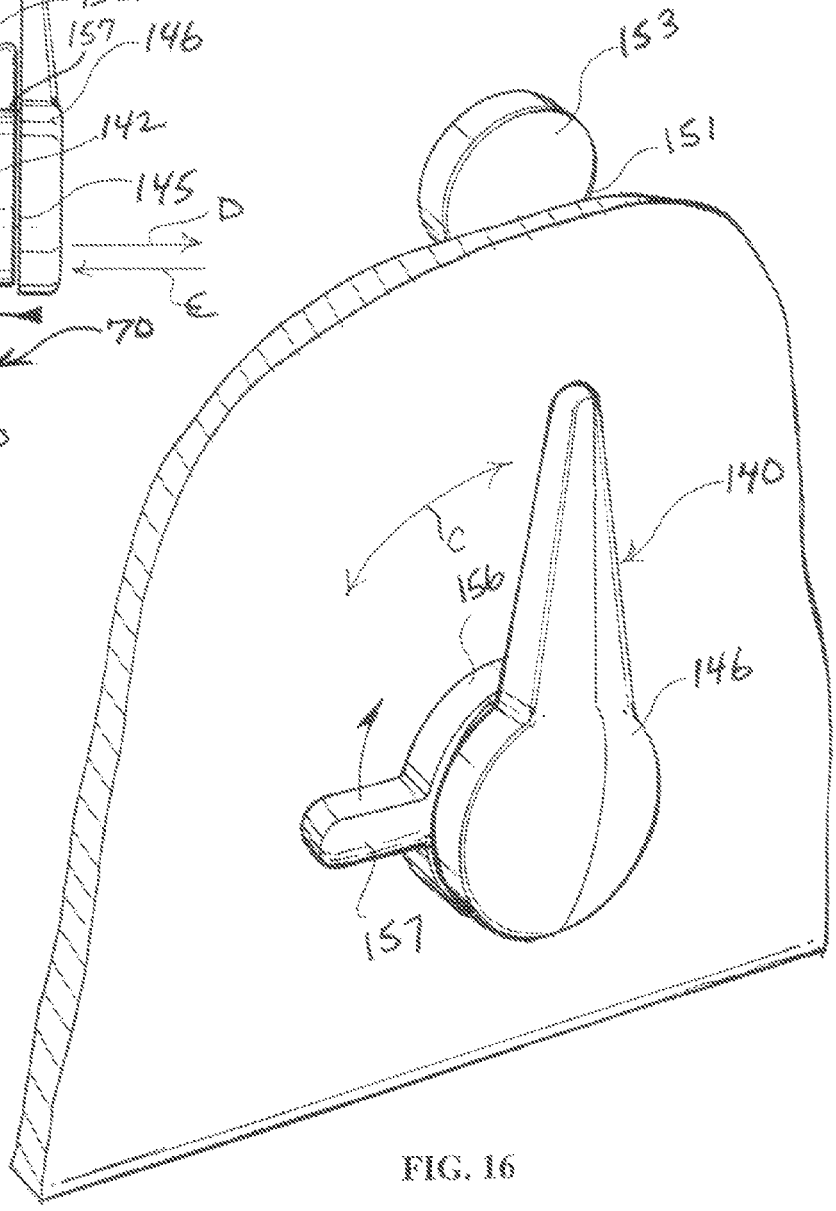
FIG. 16 is an enlarged, fragmented perspective view of an adjustment assembly for adjusting the chassis between locked and unlocked positions relative to the housing, and for adjusting the position of the chassis with respect to the housing.
Figure 18:
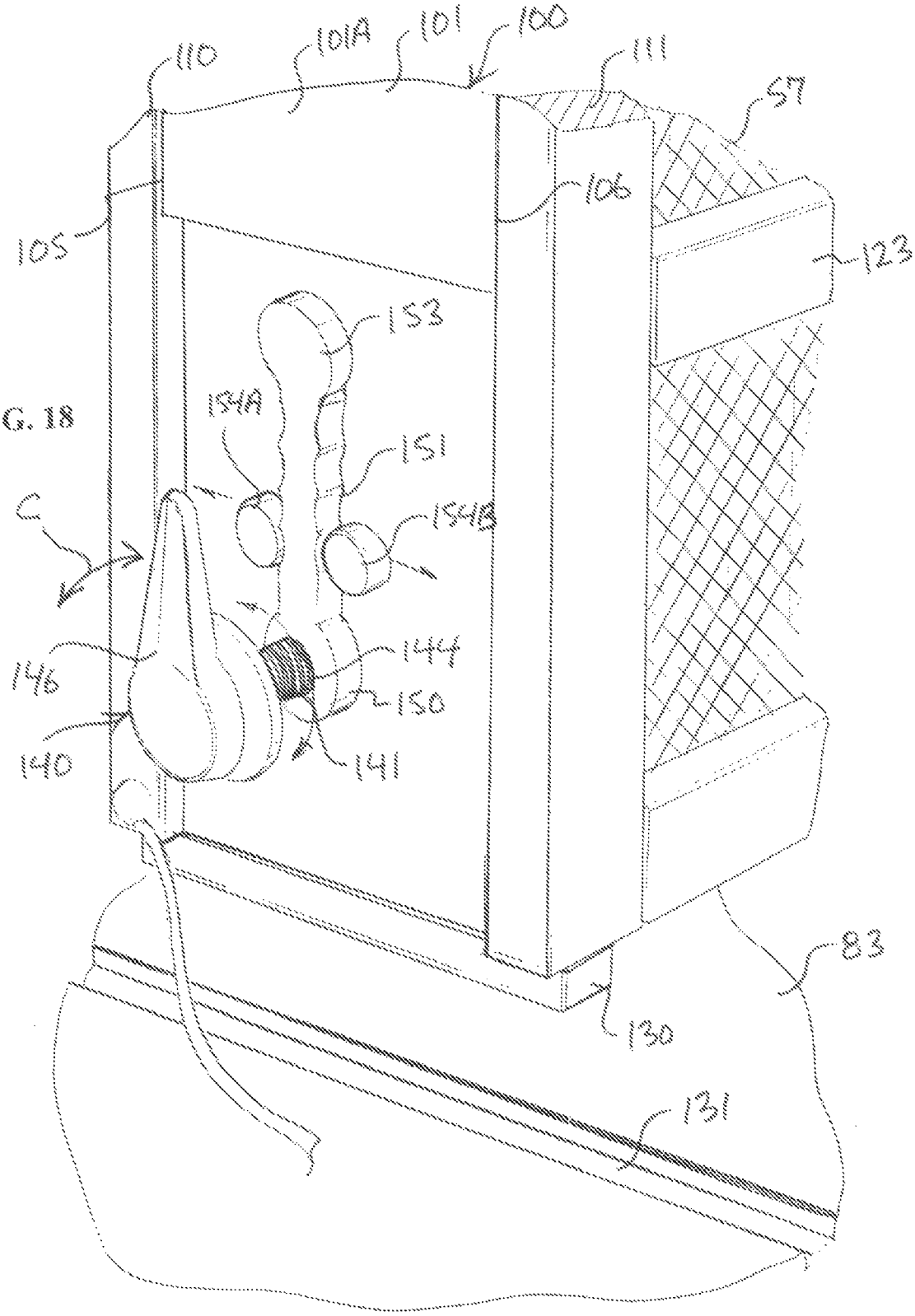
FIG. 18 is a perspective view of the adjustment assembly of FIG. 16 shown as it would appear with respect to the chassis.

As best seen in FIG. 18, opposed upstream and downstream pins 154A and 154B are secured to sidewall 101, and project outwardly from recess 152 on either side of arm 151 between upper and lower ends 153 and 150 thereof. Pins 154A and 154B are opposed, and interact with arm 151 between upper and lower ends 153 and 150 thereof. Looking to FIG. 16, dial 146, which is located exteriorly of sidewall 92 of housing 70, may be taken up by hand and rotated in opposed rotational directions as indicated by the arcuate double arrowed line C between, as indicated in FIG. 1, a first position rotated in a direction toward upstream end 72 of housing 70 and a second position rotated in a direction toward downstream end 74 of housing 70. Through the selective rotation of dial 146 as indicated, the coupling of dial 146 to lower end 150 of arm 151 with shaft 141 applies a corresponding force to arm 151, pivoting arm 151 forwardly toward upstream end 72 of housing 70 by rotating dial 146 toward upstream end 72 of housing 70, and rearwardly toward downstream end 74 of housing 70 by rotating dial 146 toward downstream end 74 of housing 70. As arm 151 is pivoted forwardly toward upstream end 72 of housing 70 through the rotation of dial 146, arm 151 interacts with upstream pin 154A, which imparts a corresponding force to chassis 100 moving chassis 100 forwardly toward upstream end 72 of housing 70 and, therefore, toward upstream electrode 56. As arm 151 is pivoted rearwardly toward downstream end 74 of housing 70, arm 151 interacts with downstream pin 154B, which imparts a corresponding force to chassis 100 moving chassis 100 rearwardly toward downstream end 74 of housing 70 and away from upstream end 72 of housing 70 and, therefore, away from upstream electrode 56. Upper end 153 of arm 151 is somewhat enlarged, which prevents upper end 153 of arm from falling free of the influence of pins 154A and 154B. As chassis 100 is moved, the tongues 130 ride along grooves 131 and tongues 133 ride along grooves 134 providing guided movement of chassis 100.

After locating chassis 100 at a selected location through the use of adjustment assembly 140 as herein described, chassis 100 may be locked in place. To lock chassis 100 in place relative to housing 70, a cam 156 is threaded on threaded shaft 141 between dial 146 and the outer surface of sidewall 92 of housing 70. Cam 156 is formed with a handle 157, which may be taken up by hand and used to rotate and maneuver cam 156. Cam 156 rotates about threaded shaft 141, and may be rotated between a forward position toward upstream end 72 of housing 70, and a rearward position toward downstream end 74 of housing 70. As cam 156 is rotated in the forward position, the threaded interaction of cam 156 with threaded shaft 141 draws shaft 141 outwardly in the direction indicated by the arrowed line D in FIG. 17, which moves arm 151 away from recess 152 toward the inner surface of sidewall 92 of housing 70 unlocking chassis 100 relative to housing 70 allowing chassis 100 to be adjusted in reciprocal directions relative to upstream electrode 56. As cam 156 is rotated in the rearward position, the threaded interaction of cam 156 with threaded shaft 141 urges shaft 141 inwardly in the direction indicated by the arrowed line E in FIG. 17, which moves arm 151 toward and against recess 152 away from the inner surface of sidewall 92 of housing 70 frictionally locking chassis 100 against and relative to housing 70 and thereby securing chassis 100 relative to housing 70.

At a fixed or predetermined voltage of power supply 121 as previously mentioned, the operating or filtering characteristics of apparatus 50 may be selectively varied principally through the adjustment of distance D1 between ionizer electrode 55 and upstream electrode 56. Again, the selected intensity of ionizing fields 60 and 61, and more importantly ionizing field 60, is largely dependent on specific needs and applications. Nevertheless, through the reciprocal adjustment of chassis 100 relative to upstream electrode 56 as herein disclosed according to the principle of the invention, distance D1 between ionizer electrode 55 and upstream electrode 56 may be decreased in order to increase the magnitude of the potential across upstream electrode 56 and also the magnitude of ionizing field 60, and increased in order to decrease the magnitude of the potential across upstream electrode 56 and also the magnitude of ionizing field 60, all while maintaining constant distance D2 between ionizer electrode 55 and downstream electrode, distance D3 between ionizer electrode 55 and upstream face 54A of filter 54, and the engagement of downstream electrode 57 against downstream face 54A of filter 54 with the provision of abutment 125 acting on downstream electrode 57.

As previously mentioned, distance D2 between ionizer electrode 55 and downstream electrode 57 is not overly critical according to the structure of apparatus 50 herein disclosed. Although in the preferred embodiment chassis 100 is mounted to housing 70 for reciprocal movement for adjusting distance D1 between ionizer electrode 55 and upstream electrode 56 without altering distance D2 between ionizer electrode 55 and downstream electrode, distance D3 between ionizer electrode 55 and upstream face 54A of filter 54, and the engagement of downstream electrode 57 against downstream face 54A of filter 54 with the provision of abutment 125 acting on downstream electrode 57, ionizer electrode 55 may be independently adjustable in reciprocal directions relative to upstream electrode, if desired, in an alternate embodiment.

Figure 19:
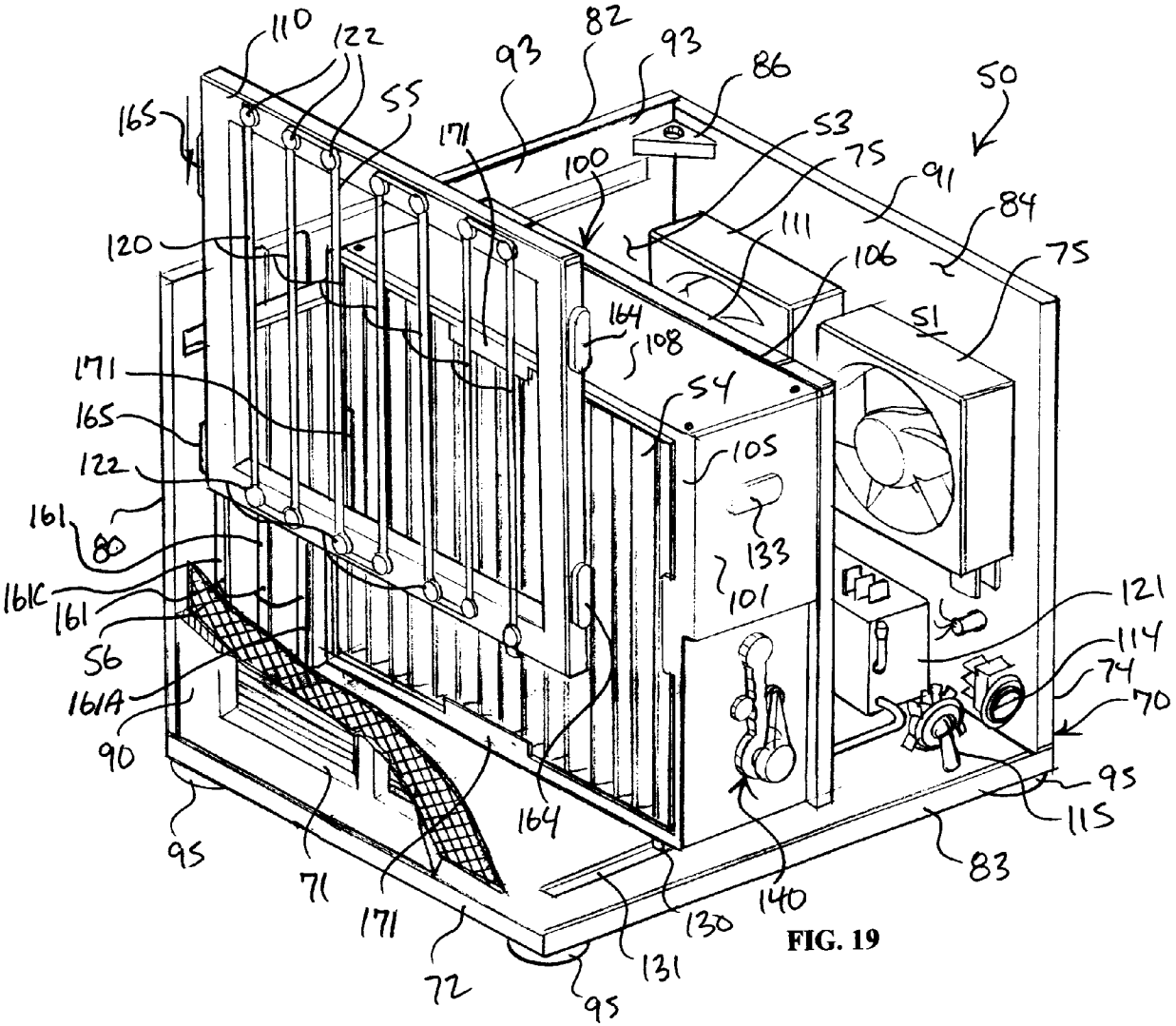
FIG. 19 is perspective view of the electrically stimulated air filter apparatus of FIG. 1 with portions of the housing removed for illustrative purposes illustrating the ionizer electrode as it would appear detached from the chassis and the housing.

Looking now to FIG. 19, to provide for the independent adjustment of ionizer electrode 55, frame 110 may be detached from chassis 100, and mounted to housing 70 for movement in reciprocal directions relative to ionizer electrode 56 for adjusting distance D1 between ionizer electrode 55 and upstream electrode 56, or otherwise engagable to housing 70 at different positions for locating ionizer electrode 55 at different positions relative to upstream electrode 56 each defining a different distance for D1. As a matter of example, frame 110 may mounted to housing 70 in much the same way, and adjusted and locked and unlocked in much the same way, as chassis 100 according to the teachings set forth herein. According to a preferred embodiment as illustrated in FIG. 14, spaced-apart, upright, parallel grooves 160 are formed in the inner surface of sidewall 92 of housing 70 inboard of front wall 90, and corresponding spaced-apart, upright, parallel grooves 161 are formed in the inner surface of sidewall 93 as shown in FIG. 19, which are equal in number to grooves 160 and oppose grooves 160. Referencing FIG. 14, three grooves 160 formed in the inner surface of sidewall 92 are illustrated, including an innermost groove 160A furthest from upstream electrode 56, an outermost groove 160A closest to upstream electrode 56, and an intermediate groove 160C located between innermost groove 160A and outermost groove 160B. Identical grooves are formed in the inner surface of sidewall 93 as shown in FIG. 19, including an innermost groove 161A furthest from upstream electrode 56, an outermost groove 161B closest to upstream electrode 56, and an intermediate groove 161C located between innermost groove 161A and outermost groove 161B.

The innermost pair of opposed grooves 160A and 161A define an innermost engagement point for frame 110, the outermost pair of opposed grooves 160A and 161A define an outermost engagement point for frame 110, and the intermediate pair of opposed grooves 160C and 161C define an intermediate engagement point for frame 110 between the innermost engagement point of frame 110 and the outermost engagement point of frame 110. As seen in FIG. 19, tongues 164 formed in a side of frame 110 are sized to be engaged and received in grooves 160, and corresponding tongues 165 formed in the opposing side of frame 110 are sized to be engaged and received in grooves 161. Tongues 164 and 165 carried by frame 110 are used to secure frame 110 to grooves 160 and 161 formed in housing 70. To mount frame 110 to housing 70 at the innermost, outermost, and intermediate engagement points, frame 110 is taken up and set into chamber 53 maneuvering tongues 164 and 165 into the opposed grooves forming the selected engagement point for frame 110, whether the innermost engagement point for frame 110 for locating ionizer electrode 55 away from upstream electrode 56 at an innermost position of ionizer electrode 55, the outermost engagement point for frame 110 locating ionizer electrode 55 toward upstream electrode 56 at an outermost position of ionizer electrode 55, or the intermediate engagement point for frame 110 locating ionizer electrode 55 between its innermost and outermost positions.

Distance D1 between ionizer electrode 55 and upstream electrode 56 at the innermost engagement point of frame 110 is greater in magnitude than distance D1 between ionizer electrode 55 and upstream electrode 56 at the intermediate engagement point of frame 110, and is still greater in magnitude than distance D1 between ionizer electrode 55 and upstream electrode 56 at the outermost engagement point of frame 110. As previously explained, the magnitude of ionizing fields 60 and 61 is determined principally by the voltage provided by power supply 121 across ionizer electrode 55, in addition to the magnitude of distances D1 and D2. At a fixed or predetermined voltage of power supply 121, the magnitude of ionizing field 60 is minimized at the innermost engagement point for frame 110 locating ionizer electrode 55 away from upstream electrode 56 at the innermost position of ionizer electrode 55, the magnitude of ionizing field 60 is maximized at the outermost engagement point for frame 110 locating ionizer electrode 55 toward upstream electrode 56 at the outermost position of ionizer electrode 55, and the magnitude of ionizing field 60 falls between the minimized and maximized magnitudes of ionizer electrode 55 at the intermediate engagement point for frame 110 locating ionizer electrode 55 between its innermost and outermost positions. Accordingly, at a fixed or predetermined voltage of power supply 121, frame 110 may be located at either of its innermost, outermost, or intermediate engagement points of housing 70 for providing a selected order of magnitude for ionizing field 60, or otherwise for tuning apparatus 50 to selected magnitude for ionizing field 60, according to the principle of the invention. In the embodiment in which frame 110 is detached from chassis 100 and engagable to housing 70 at different positions relative to upstream electrode 60 as herein explained, the remaining structure of chassis 100, including filter 54 and downstream electrode 47 and abutment 125, remain the same and function as previously discussed.

In the present embodiment, grooves 160 and 161 provide three engagement points for frame 110 for locating ionizer electrode 55 at three different locations relative to upstream electrode 55. It is to be understood that any number of corresponding grooves 160 and 161 may be provided for providing any selected number of engagement points for frame 110 for providing any number of corresponding positions of ionizer electrode 55 each defining a different distance D1 relative to upstream electrode 55. Furthermore, although grooves are carried by housing 70 and corresponding tongues are carried by frame 110, this arrangement can be reversed.

As illustrated in FIG. 19, tabs 171 are formed at open upstream end 105 of chassis 100. Tabs 171 extends inwardly relative to open upstream end 105 opposing upstream face 54A of filter 54, and confront and interact with upstream face 54A of filter 54 at the marginal edges of filter 54 preventing filter 54 from falling outwardly through open upstream end 105 due to the force applied to filter 54 by the urging of downstream electrode 57 against downstream face 54B of filter 54 by abutment 125 as previously discussed. In the present embodiment, four tabs 171 are provided, although less or more can be used. If desired, tabs 171 may be joined forming an annular flange at open upstream end 105 of chassis 100.

Figure 10:
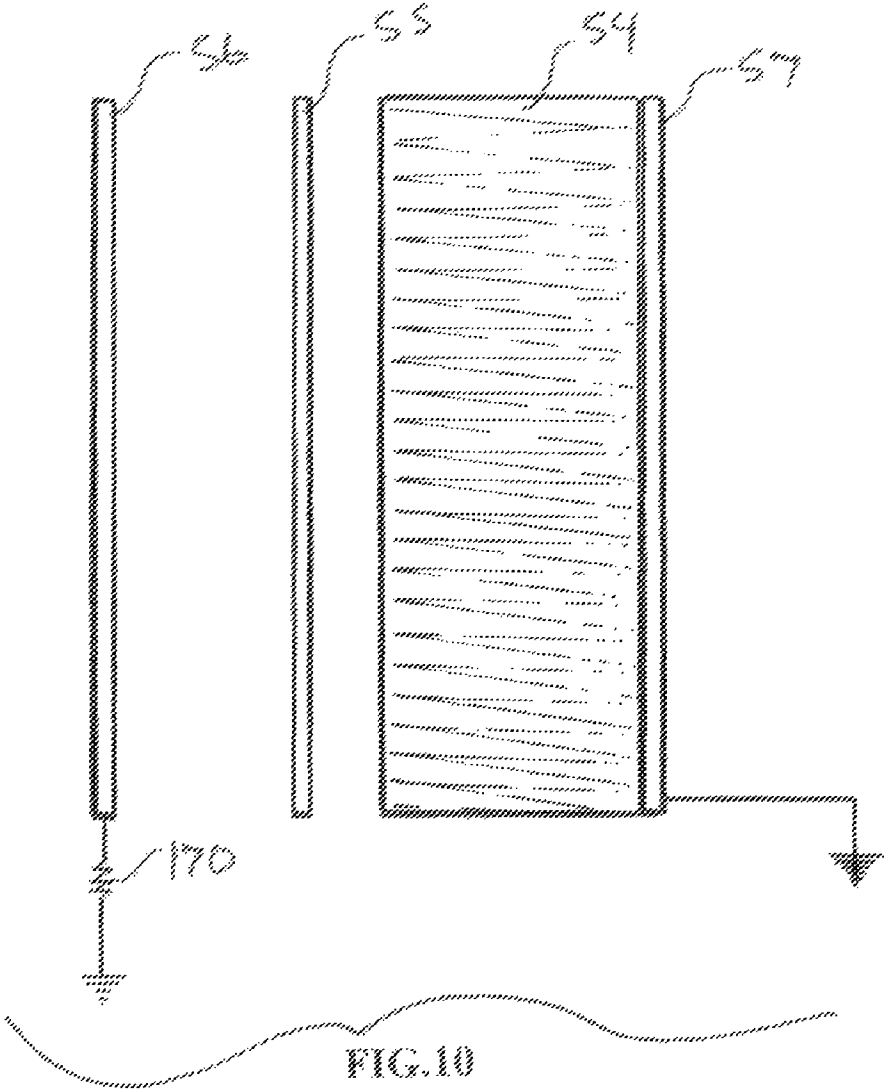
FIG. 10 is a highly generalized view of the upstream electrode of FIG. 8 shown as it would appear coupled to a resistor.

To further enhance the ability to tune apparatus 50 as needed or desired to meet a specific application, FIG. 10 is a highly generalized view of upstream electrode 56 shown as it would appear coupled to a resistor 170, which is grounded and which may be set to a predetermined voltage value to achieve a selected magnitude of the potential across upstream electrode 56 and thus a selected magnitude of ionizing field 60. Resistor 170 may be set to any selected voltage value for tuning upstream electrode 56, namely, for establishing a selected magnitude of the potential across upstream electrode 56 for establishing a selected magnitude of ionizing field 60.

Figure 11:
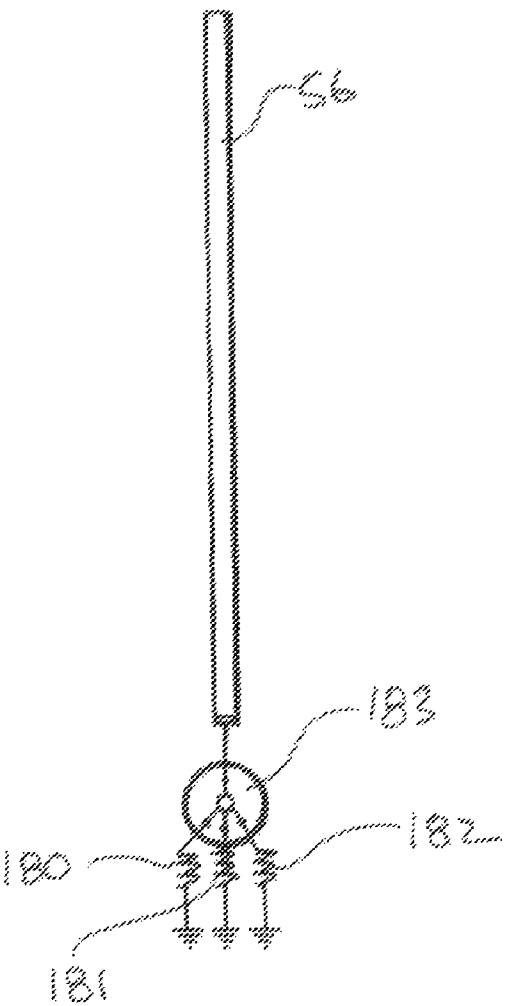
FIG. 11 is a highly generalized view of the upstream electrode of FIG. 8 shown as it would appear coupled to a plurality of resistors with a switch.

If desired, a plurality or array of grounded resistors may be coupled to upstream electrode 56, and FIG. 11 is illustrative of this embodiment of the invention. FIG. 11 is a highly generalized view of upstream electrode 56 shown as it would appear coupled to resistors 180, 181, and 182 with a switch 183. Resistors 180, 181, and 182 each yield a different voltage, and switch 183 is used to switch between resistors 180, 181, and 182 for setting upstream electrode 56 to a selected voltage value for establishing a selected magnitude of ionizing field 60. In FIG. 11, three resistors having a different voltage values are illustrated, with the understanding that less or more different resistors having different voltage values may be employed for providing a desired tuning of upstream electrode 56.

Those having regard for the art will readily appreciate that a highly efficient and tunable electrically stimulated air filter apparatus 50 is disclosed, which is used principally for removing particles from an air stream, such as dust particles, mold particles, microbial particles, smoke particles, and other air-borne particles. Apparatus 50 is self contained, may be used in any application in which air filtration is desired, such as for providing cleaned breathing air, for providing cleaned air for scientific or experimentation applications, or the like. Apparatus 50 is useful in that apparatus 50 provides for the efficient and exemplary removal of particles from an air stream, provides for the suppression of odors in odoriferous air caused by particles that impart undesired odors, such as air contaminated with cigarette smoke, and is capable of removing particles such as germs and other microbial agents from an air stream, including contagious airborne pathogen particles, legionella particles, sars particles, bacillus subtilis particles, serratia merescens particles, aspergillus versicolor particles, etc. Also, tests conducted with apparatus 50 show that exposure of germs and microbial particles, such as bacillus subtilis, serratia merescens, aspergillus versicolor, and the like, trapped in filter 54 to the electrostatic fields generated by apparatus 50 kill or otherwise neutralize such particles, according to the principle of the invention. If desired, apparatus 50 may be incorporated into an HVAC system for filtering the air stream through the HVAC system.

The invention has been described above with reference to preferred embodiments. However, those skilled in the art will recognize that changes and modifications may be made to the embodiments without departing from the nature and scope of the invention. For instance, although power supply 121 is an AC to DC non-regulated high voltage power supply, it may be provided as AC to DC regulated high voltage power supply, if desired, for allowing the voltage applied across ionizer electrode 55 to be varied for varying the potentials across the upstream and downstream electrodes 56 and 57. Regulated power supplies for larger systems constructed and arranged in accordance with the principle of the invention allows the efficiency to be maintained even when the filter loads up with particulates. Furthermore, apparatus 50 can, if desired, be configured with a safety or cut-off switch for use in providing an immediate shutdown of apparatus 50 should the need arise. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. Apparatus, comprising:

a chamber;

an air inlet leading to an air flow pathway through the chamber;

an air outlet leading from the air flow pathway through the chamber;

a filter disposed in the air flow pathway between the air inlet and the air outlet for entrapping contaminants in an air stream passing through the air flow pathway from the air inlet to the air outlet;

an ionizer electrode, electrically connected for carrying a first potential, disposed in the air flow pathway between the air inlet and the filter;

an upstream electrode disposed in the air flow pathway between the air inlet and the ionizer electrode;

a downstream electrode disposed in the air flow pathway between the air outlet and the filter;

an abutment comprising a support member and a length of spring steel, the abutment being disposed in the air flow pathway between the air outlet and the downstream electrode, the abutment acting on the downstream electrode urging the downstream electrode in contact against the filter;

the first potential carried by the ionizer electrode imparting through induction a) a second potential to the upstream electrode forming a first ionizing field between the upstream electrode and the ionizer electrode, and b) a third potential to the downstream electrode forming a second ionizing field between the downstream electrode and the ionizer electrode; and the abutment acting on the downstream electrode urging the downstream electrode in contact against the filter maintaining the second ionizing field with the filter.

2. Apparatus according to claim 1, wherein the upstream electrode is electrically isolated inhibiting arcing from occurring at the upstream electrode.

3. Apparatus according to claim 2, wherein the downstream electrode is grounded.

4. Apparatus according to claim 1, further comprising a resister coupled to the upstream potential and adjusted to obtain a predetermined value of the first potential.

5. Apparatus according to claim 4, wherein the downstream electrode is grounded.

6. Apparatus according to claim 1, wherein the filter comprises a dielectric filter.

7. Apparatus according to claim 1, wherein the ionizer electrode comprises a planar array of ionizing wires parallel to the upstream electrode and the downstream electrode.

8. Apparatus, comprising:

a housing defining a chamber, an air inlet leading to an air flow pathway through the chamber, and an air outlet leading from the air flow pathway through the chamber;

a filter disposed in the air flow pathway between the air inlet and the air outlet for entrapping contaminants in an air stream passing through the air flow pathway from the air inlet to the air outlet;

an ionizer electrode disposed in the air flow pathway between the air inlet and the filter, the ionizer electrode electrically connected for carrying a first potential and carried by a frame;

an upstream electrode disposed in the air flow pathway between the air inlet and the ionizer electrode;

a downstream electrode, engaged to the filter, disposed in the air flow pathway between the air outlet and the filter;

the first potential carried by the ionizer electrode imparting through induction a) a second potential to the upstream electrode forming a first ionizing field between the upstream electrode and the ionizer electrode, and b) a third potential to the downstream electrode forming a second ionizing field between the downstream electrode and the ionizer electrode;

the engagement of the downstream electrode with the filter maintaining the second ionizing field with the filter;

the frame engagable to the housing at a first position of the ionizer electrode toward the upstream electrode and away from the downstream electrode for increasing the second potential of the upstream electrode and decreasing the third potential of the downstream electrode, and a second position of the ionizer electrode away from the upstream electrode and toward the downstream electrode for decreasing the second potential of the upstream electrode and increasing the third potential of the downstream electrode; and an abutment comprising a support member and a length of spring steel, the abutment being disposed in the air flow pathway between the air outlet and the downstream electrode, the abutment acting on the downstream electrode urging the downstream electrode in contact against the filter.

9. Apparatus according to claim 8, further comprising means for releasably securing the frame in the first and second positions of the ionizer electrode including an element thereof carried by the frame, and first and second complemental elements thereof carried by the housing, the first complemental element releasably engaged to the element corresponding to the first position of the ionizer electrode and the second complemental element releasably engaged to the element corresponding to the second position of the ionizer electrode.

10. Apparatus according to claim 8, wherein the upstream electrode is electrically isolated inhibiting arcing from occurring at the upstream electrode.

11. Apparatus according to claim 10, wherein the downstream electrode is grounded.

12. Apparatus according to claim 8, further comprising a resister coupled to the upstream potential and adjusted to obtain a predetermined value of the first potential.

13. Apparatus according to claim 12, wherein the downstream electrode is grounded.

14. Apparatus according to claim 8, wherein the filter comprises a dielectric filter.

15. Apparatus according to claim 8, wherein the ionizer electrode comprises a planar array of ionizing wires parallel to the upstream electrode and the downstream electrode.

16. Apparatus according to claim 15, wherein the upstream electrode is electrically isolated inhibiting arcing from occurring at the upstream electrode.

17. Apparatus according to claim 16, wherein the downstream electrode is grounded.

18. Apparatus, comprising:

a housing defining a chamber, an air inlet leading to an air flow pathway through the chamber, and an air outlet leading from the air flow pathway through the chamber;

a filter disposed in the air flow pathway between the air inlet and the air outlet for entrapping contaminants in an air stream passing through the air flow pathway from the air inlet to the air outlet;

an ionizer electrode, electrically connected for carrying a first potential, disposed in the air flow pathway between the air inlet and the filter;

an upstream electrode disposed in the air flow pathway between the air inlet and the ionizer electrode;

a downstream electrode disposed in the air flow pathway between the air outlet and the filter;

an abutment comprising a support member and a length of spring steel, the abutment being disposed in the air flow pathway between the air outlet and the downstream electrode, the abutment acting on the downstream electrode urging the downstream electrode in contact against the filter;

the first potential carried by the ionizer electrode imparting through induction a) a second potential to the upstream electrode forming a first ionizing field between the upstream electrode and the ionizer electrode, and b) a third potential to the downstream electrode forming a second ionizing field between the downstream electrode and the ionizer electrode;

the abutment acting on the downstream electrode urging the downstream electrode in contact against the filter maintaining the second ionizing field with the filter;

the ionizer electrode, the filter, and the abutment secured to a chassis mounted to the housing for movement between a first position of the ionizer electrode, the filter and the abutment toward the upstream electrode for increasing the second potential of the upstream electrode, and a second position of the ionizer electrode, the filter, and the abutment away from the upstream electrode for decreasing the second potential of the upstream electrode.

19. Apparatus according to claim 18, further comprising a resister coupled to the upstream potential and adjusted to obtain a predetermined value of the first potential.

20. Apparatus according to claim 19, wherein the downstream electrode is grounded.

21. Apparatus according to claim 18, wherein the filter comprises a dielectric filter.

22. Apparatus according to claim 18, wherein the ionizer electrode comprises a planar array of ionizing wires parallel to the upstream electrode and the downstream electrode.

23. Apparatus according to claim 18, further comprising means for releasably securing the chassis in a fixed position relative to the housing.

* * * * *